US008215131B2

(12) United States Patent
Hirano et al.

(10) Patent No.: US 8,215,131 B2
(45) Date of Patent: Jul. 10, 2012

(54) KNITTING ELEMENT COMPRISING ROTOR AND KNITTING MACHINE

(75) Inventors: Hideo Hirano, Nara (JP); Kousuke Noguchi, Nara (JP)

(73) Assignee: Okamoto Corporation, Nara (JP)

( * ) Notice: Subject to any disclaimer, the term of this patent is extended or adjusted under 35 U.S.C. 154(b) by 0 days.

(21) Appl. No.: 13/238,310

(22) Filed: Sep. 21, 2011

(65) Prior Publication Data

US 2012/0079854 A1 Apr. 5, 2012

(30) Foreign Application Priority Data

Sep. 30, 2010 (JP) ..... P2010-221470
Sep. 7, 2011 (JP) ..... P2011-195418

(51) Int. Cl.
*D04B 35/00* (2006.01)

(52) U.S. Cl. ..... 66/1 R

(58) Field of Classification Search ..... 66/1 R, 66/116, 123, 3

See application file for complete search history.

(56) References Cited

U.S. PATENT DOCUMENTS 3,971,232 A 7/1976 Darling
3,982,409 A * 9/1976 Conroux et al. ..... 66/1 R
4,034,577 A * 7/1977 Puthon ..... 66/1 R

FOREIGN PATENT DOCUMENTS

EP 2 192 219 6/2010
FR 2 389 699 12/1978
JP 2010-126830 6/2010

OTHER PUBLICATIONS

European Search Report for EP 11182007, mailed Feb. 28, 2012, 8 pgs.

* cited by examiner

*Primary Examiner* — Danny Worrell
(74) *Attorney, Agent, or Firm* — Squire Sanders (US) LLP

(57) ABSTRACT

The knitting element has a rotor capable of rotating about an axis and makes a knit stitch by using rotational motion of the rotor. The rotor is formed in a circular disk shape. A pair of bearing plates is separated from each other in a radial direction of the rotor. The rotor is supported rotatably by bearing plates support slidably the circumferential surface of the rotor. A plurality of teeth to which rotational drive force is transmitted is formed in a circumference edge portion of the rotor. An engagement recess capable of engaging knitting yarn is formed in the circumferential face of the rotor.

7 Claims, 35 Drawing Sheets

KNITTING ELEMENT COMPRISING ROTOR AND KNITTING MACHINE

BACKGROUND OF THE INVENTION

1. Field of the Invention

The present invention relates to a knitting element comprising a rotor and to a knitting machine.

2. Related Background Art

Conventionally, as technology in a field of this kind, a rotary knitting machine is known which forms stitches by using the rotary motion of a circular disk-shaped rotor (see, for example, U.S. Pat. No. 3,971,232). In this rotary knitting machine, hooks for capturing a knitting yarn are formed on the circumference of the main body of the round disk-shaped rotor. Teeth which mesh with a rack that moves linearly are formed on the circumferential surface of the main body of the rotor. The main body of the rotor is held by a holding guide which guides the circumferential surface of the rotor slidably, and is composed so as to rotate in accordance with the linear movement of the rack. Furthermore, in the rotary knitting machine described in U.S. Pat. No. 3,971,232, a plurality of rotors required for forming stitches are held by a holding guide having an integrated structure.

Furthermore, the technology described in Japanese Patent Application Publication No. 2010-126830 is disclosed as a knitting element comprising a rotor and knitting machine. The knitting element described in Japanese Patent Application Publication No. 2010-126830 has a rotor which is rotatable about an axis, and a rotational axle which projects in the axial direction is provided on this rotor.

However, in the prior art technology described in U.S. Pat. No. 3,971,232 above, since a plurality of rotors required for forming stitches are held by a holding guide having an integrated structure, then there is a problem in that the rotation of the rotors cannot be controlled independently. Therefore, a knitting element which can be employed in a practicable knitting machine is demanded.

Furthermore, in the technology described in Japanese Patent Application Publication No. 2010-126830, since a rotational axle which projects in the axial direction is provided on the rotor, then there is a problem in that processing costs are involved. Therefore, a knitting element which comprises rotors having a simple composition and which enables the rotation of the rotors to be controlled independently is demanded.

SUMMARY OF THE INVENTION

The present invention was devised in order to resolve problems of this kind, an object thereof being to provide a knitting element which can be employed in a practicable knitting machine and which enables the rotation of rotors to be controlled independently, and a knitting machine comprising this knitting element and a rotor of a knitting element.

The knitting element according to the present invention is a knitting element which has a rotor capable of rotating about an axis, and carries out knitting using a rotational movement of the rotor, the knitting element comprising: the rotor, which is formed in a circular disk shape, and the circumferential surface of which forms a sliding surface; a pair of bearing plates which are separated from each other in a radial direction of the rotor and slidably support the circumferential surface of the rotor; and a pair of supporting plates which are disposed on either side of the rotor in a thickness direction so as to sandwich the rotor and the pair of bearing plates, and which support the rotor and the pair of bearing plates, wherein the bearing plates and the supporting plates are integrated to constitute a thin plate shape, the rotor is provided with an engaging recess section which passes through the rotor in the thickness direction and is opened from the circumferential surface side toward the inside of the rotor, a plurality of teeth to which rotational drive force is transmitted are formed in a circumference edge portion of the rotor, and a knitting yarn introduction opening through which a knitting yarn enters and exits from the engaging recess section is formed in each of the pair of supporting plates.

According to a knitting element which is composed in this way, since the circumferential surface of the rotor forms a sliding surface, then it is possible to rotate the rotor suitably without using a rotational axle which projects in the thickness direction. Furthermore, a plurality of teeth are formed on the circumferential surface of a rotor, and therefore it is possible to transmit rotational drive force via this plurality of teeth. The rotor, the bearing plates and the supporting plates can all be formed from plate material, and the processing costs can be restricted. Furthermore, the rotor, bearing plates and supporting plates are formed in an integrated fashion, and therefore it is possible to control the rotation of the rotor independently. Moreover, since the rotor, the bearing plates and the supporting plates are formed in a thin plate shape, then the structure is simple and the knitting machine can be made compact in size. By forming all of the components in a plate shape, it is possible to facilitate the design process.

Moreover, a plurality of teeth are formed in the circumference edge portion of the rotor, and the rotation of respective rotors can be controlled independently using a drive gear wheel which meshes with these teeth.

Furthermore, the rotor according to the present invention is a rotor of a knitting element which carries out knitting using a rotational movement; comprising: a rotor main body, which is formed in a circular disk shape, and the circumferential surface of which forms a sliding surface, wherein the rotor main body is provided with an engaging recess section which passes through the rotor main body in a thickness direction and is opened from the circumferential surface side toward the inside of the rotor main body, and a plurality of teeth to which rotational drive force is transmitted are formed in a circumference edge portion of the rotor.

According to a rotor which is composed in this way, since the circumferential surface of the rotor main body forms a sliding surface, then it is possible to rotate the rotor suitably without using a rotational axle which projects in the thickness direction. Furthermore, a plurality of teeth are formed on the circumferential surface of a rotor main body, and therefore it is possible to transmit rotational drive force via this plurality of teeth. The rotor can be formed from a plate material, and processing costs can be restricted.

Moreover, a plurality of teeth are formed in the circumference edge portion of the rotor, and the rotation of respective rotors can be controlled independently using a drive gear wheel which meshes with these teeth.

Furthermore, desirably, the engaging recess section is formed more deeply in a radial direction of the rotor main body than a recess section formed between the plurality of teeth. By adjusting the depth of the engaging recess section in this way, it is possible to adjust the loop length appropriately.

Furthermore, desirably, the engaging recess section is formed deeply beyond the center of the rotor main body to the opposite side, in side view. By adjusting the depth of the engaging recess section in this way, it is possible to adjust the loop length appropriately.

Furthermore, desirably, a step difference is formed in the engaging recess section so as to be able to engage a plurality of knitting yarns at different positions. Consequently, a rotor suited to pile knitting can be achieved.

Furthermore, the circular knitting machine according to the present invention has a rotor which can rotate about an axis extending in a first direction, and includes: a knitting element which carries out knitting using a rotational movement of the rotor; a sinker which holds a knitting yarn that has been supplied to the knitting element; and a holding platform which holds the knitting element and the sinker and causes the knitting element and the sinker to rotate about a second axis extending in a second direction perpendicular to the first direction, wherein the knitting element includes: the rotor, which is formed in a circular disk shape, and the circumferential surface of which forms a sliding surface; a pair of bearing plates which are separated from each other in a radial direction of the rotor and slidably support the circumferential surface of the rotor; and a pair of supporting plates which are disposed on either side of the rotor in a thickness direction so as to sandwich the rotor and the pair of bearing plates, and which support the rotor and the pair of bearing plates, and wherein the bearing plates and the supporting plates are integrated to constitute a thin plate shape, the rotor is provided with an engaging recess section which passes through the rotor in the thickness direction and is opened from the circumferential surface side toward the inside of the rotor, a plurality of teeth to which drive force is transmitted are formed in a circumference edge portion of the rotor, and a knitting yarn introduction opening through which a knitting yarn enters and exits from the engaging recess section is formed in each of the pair of supporting plates.

According to a circular knitting machine which is composed in this way, since the knitting element comprises a rotor which can rotate and the circumferential surface of the rotor forms a sliding surface, then it is possible to rotate the rotor suitably without using a rotational axle which projects in the thickness direction. Furthermore, a plurality of teeth are formed on the circumferential surface of a rotor, and therefore it is possible to transmit rotational drive force via this plurality of teeth. The rotor, the bearing plates and the supporting plates can all be formed from plate material, and the processing costs can be restricted. Furthermore, the rotor, bearing plates and supporting plates are formed in an integrated fashion, and therefore it is possible to control the rotation of the rotor independently. Moreover, since the rotor, the bearing plates and the supporting plates are formed in a thin plate shape, then the structure is simple and the knitting machine can be made compact in size. By forming all of the components in a plate shape, it is possible to facilitate the design process.

Moreover, a plurality of teeth are formed in the circumference edge portion of the rotor, and the rotation of respective rotors can be controlled independently using a drive gear wheel which meshes with these teeth.

Furthermore, desirably, the knitting machine comprises a rotor drive gear wheel which meshes with a plurality of teeth provided on the circumference edge portion of the rotor; and a rotor servo motor which applies rotational drive force to the rotor drive gear wheel. By this means, it is possible to control the angle of rotation of the rotor appropriately, by using a servo motor. In contrast to a method which drives a rotor by using a conventional cam, it is possible to control the angle of rotation of respective rotors, and therefore complicated knitting structures can be formed using the rotors.

DESCRIPTION OF THE PREFERRED EMBODIMENTS

Figure 1:
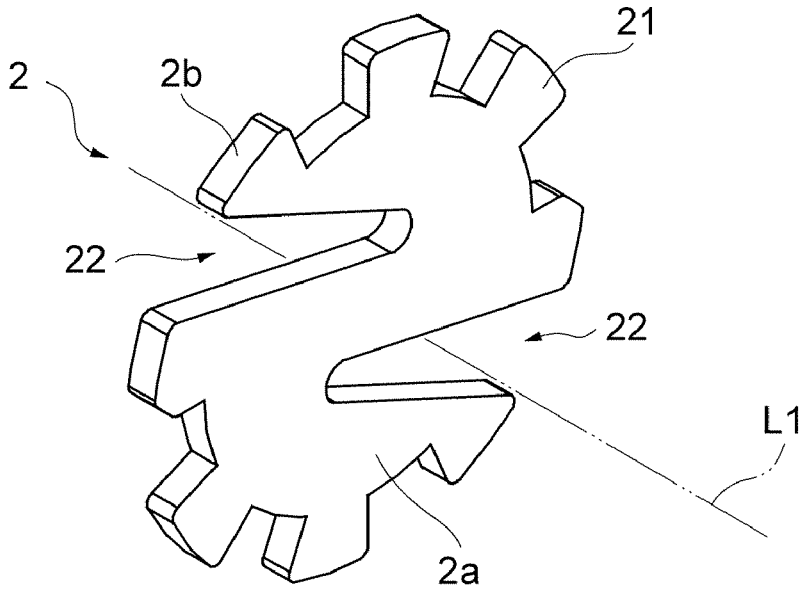
FIG. 1 is a perspective diagram of a rotor relating to a first embodiment of the present invention.

Below, a preferred embodiment of the present invention is described in detail with reference to the accompanying drawings. In the respective drawings, the same or corresponding elements are labeled with the same reference numerals, and repeated description is omitted.

(Rotor)

FIG. 1 is a perspective diagram of a rotor relating to a first embodiment of the present invention. The rotor 2 shown in FIG. 1 is formed in a circular disk shape, is mounted on a knitting element 1 (see FIG. 4 to FIG. 6) and is rotatable about a prescribed axis of rotation L1.

The main surface 2*a* which opposes the direction of the axis of rotation L1 of the rotor 2 is formed as a flat surface. In the rotor 2, projecting sections which project in the direction of the axis of rotation L1 are not formed, and the rotor 2 has a uniform thickness. Rotor (gear) teeth 21 for transmitting drive force to the rotor 2 are provided on the circumference edge portion of the rotor 2. The rotor teeth 21 are arranged equidistantly about the whole circumference. In the rotor 2 according to the present embodiment, there are eight teeth. The rotor teeth 21 mesh with a gear which is provided on the output shaft of a rotor drive motor, whereby drive force is applied thereto and the rotor 2 turns about the axis of rotation L1. In the present embodiment, there are eight teeth on the rotor 2, but the number of teeth on the rotor 2 is not limited to eight.

Furthermore, the circumferential surface of the rotor 2 (the front end faces of the rotor teeth 21) functions as a sliding surface. The rotor 2 is supported rotatably by inner plates 13, 14 (see FIG. 6) which are described hereinafter.

A pair of hooks 22 (engaging recess sections) for stitching knitting yarns are formed in the rotor 2 (main body of the rotor). The hooks 22 are formed so as to be recessed towards the center (inner side) of the rotor 2 from the circumference side. The hooks 22 may be formed beyond the center toward the opposite side, in the radial direction of the rotor 2. The hooks 22 pass through from one main surface 2*a* to the other main surface 2*a* in the thickness direction of the rotor 2. Two hooks 22 are formed in the rotor at two corresponding positions on the circular circumference of the rotor. Furthermore, it is also possible to provide more than two hooks 22 (for example, three or four hooks).

Desirably, the hooks 22 are formed more deeply in the radial direction of the rotor 2 than the recess portions formed between the rotor teeth 21, but they may also be of approximately the same depth as the recess portions between the rotor teeth 21.

(Rotor According to Second Embodiment)

Figure 2:
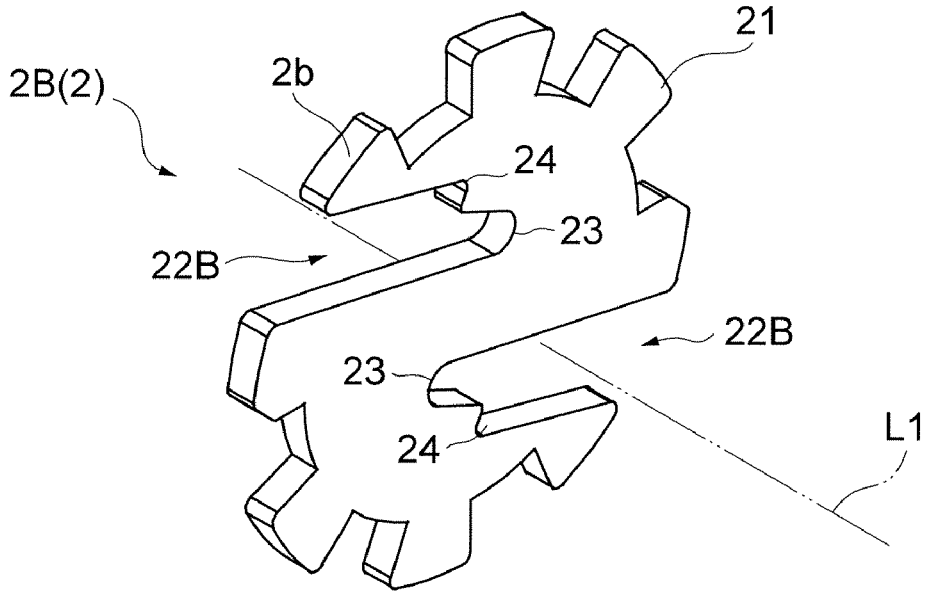
FIG. 2 is a perspective diagram of a rotor relating to a second embodiment of the present invention.

FIG. 2 is a perspective diagram of a rotor relating to a second embodiment of the present invention. The difference between the rotor 2B according to the second embodiment which is shown in FIG. 2 and the rotor 2 according to the first embodiment is that the shape of the hooks 22B is different. A step section is provided in the hooks 22B, whereby bottom sections 23, 24 where knitting yarns are formed are created in two positions. In this way, since a step section is provided in each hook 22B, thereby forming a plurality of bottom sections 23, 24, then by forming separate knitting yarns respectively in each bottom section, two stitches of different loop length are formed, and it is thus possible to form a pile stitch. The rotor 2B can be used as a pile rotor.

(Rotor According to Third Embodiment)

Figure 3:
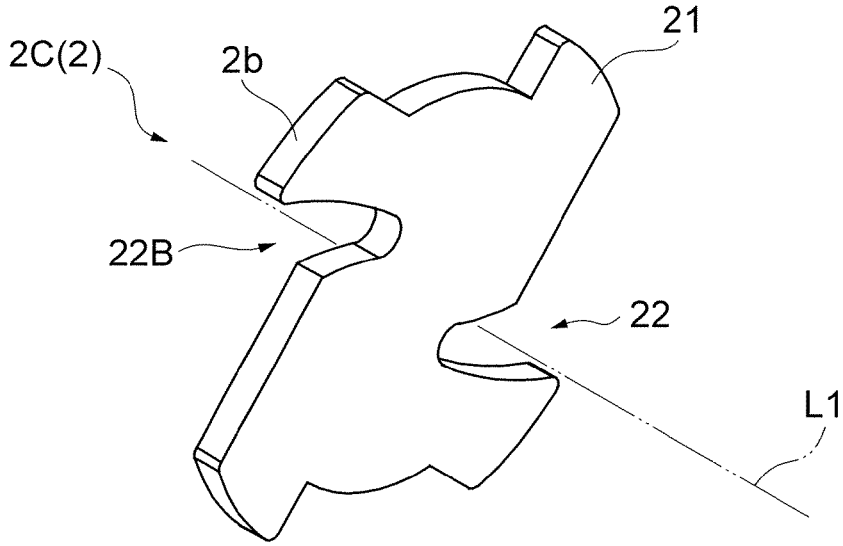
FIG. 3 is a perspective diagram of a rotor relating to a third embodiment of the present invention.

FIG. 3 is a perspective diagram of a rotor relating to a third embodiment of the present invention. The difference between the rotor 2C according to the third embodiment which is shown in FIG. 3 and the rotor 2 according to the first embodiment is that the number of rotor teeth 21 formed in the circumference edge portion is different. In the rotor 2C, there are four teeth.

(Knitting Element)

Figure 4:
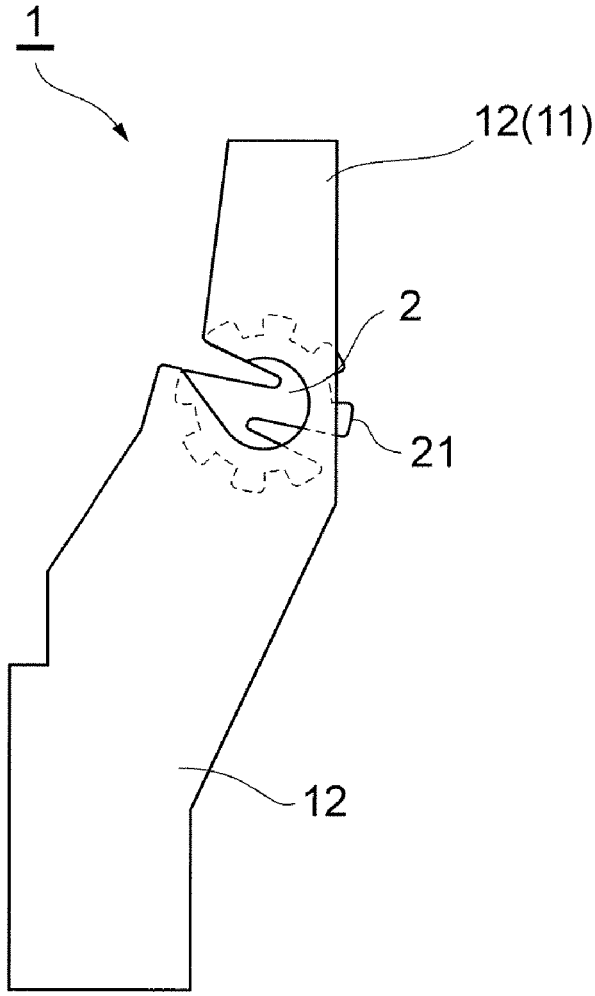
FIG. 4 is a side view of a knitting element relating to an embodiment of the present invention.
Figure 5:
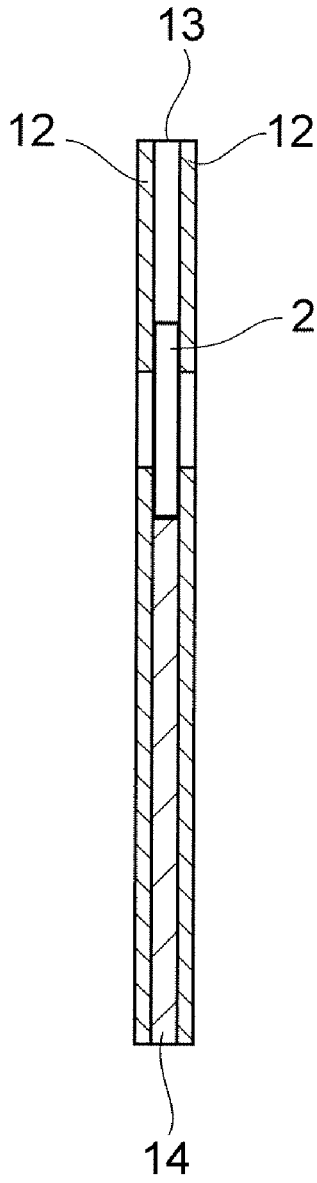
FIG. 5 is a front view of a knitting element relating to an embodiment of the present invention.
Figure 6:
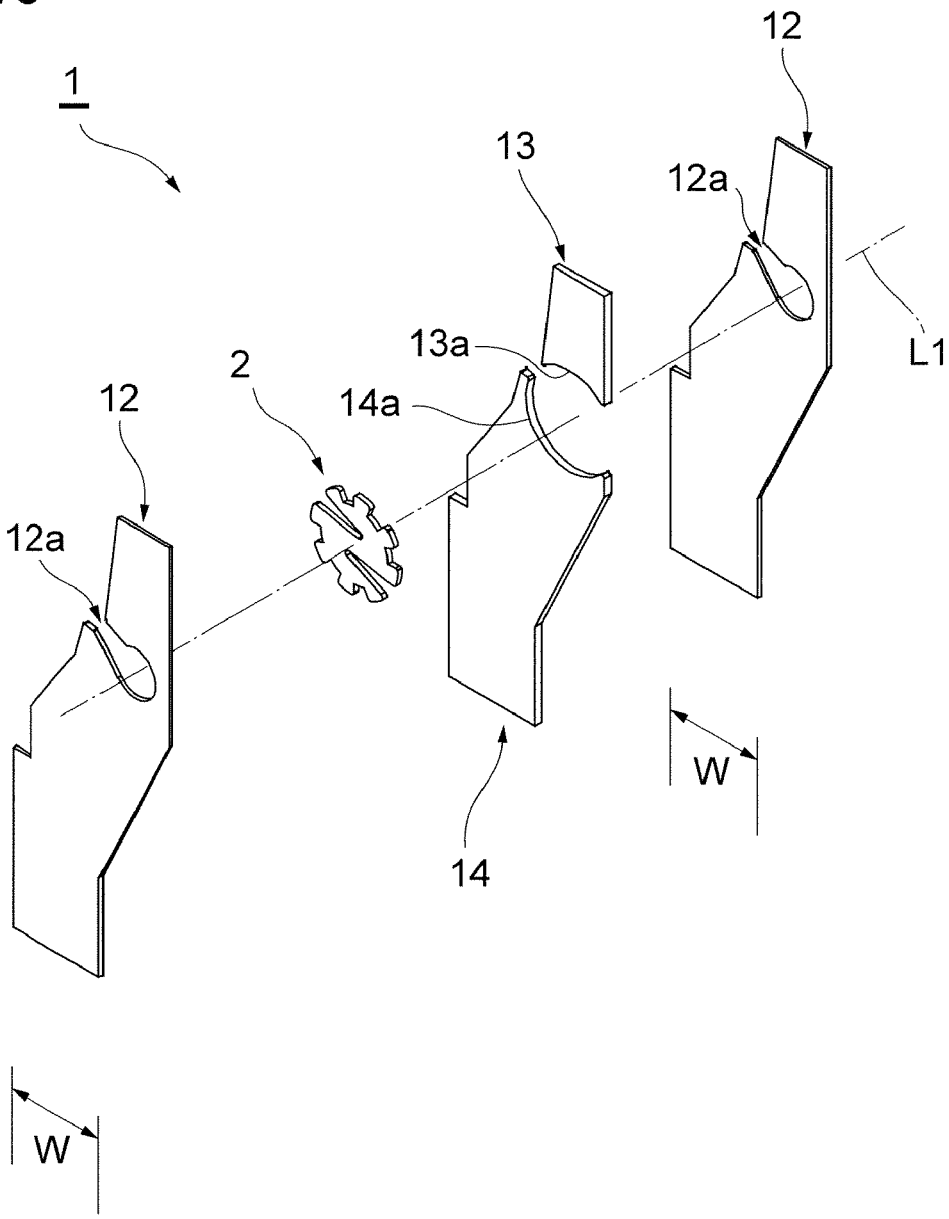
FIG. 6 is an exploded perspective diagram of a knitting element relating to an embodiment of the present invention.

FIG. 4 is a side view of a knitting element relating to the present embodiment. FIG. 5 is a front view of a knitting element relating to the present embodiment. FIG. 6 is an exploded perspective view of a knitting element relating to the present embodiment. In the description of the knitting element 1, when the knitting element 1 is mounted on a circular knitting machine 100, the surface facing towards the center of the knitting machine 100 is taken to be the rear face of the knitting element 1, and the surface facing toward the outside of the knitting machine 100 is taken to be the front face of the knitting element 1.

The knitting element 1 which is shown in FIG. 4 to FIG. 6 is mounted on a circular knitting machine 100, for example, and is used in the knitting of socks, or the like. The knitting element 1 comprises a rotor 2, outer plates 12, and inner plates 13, 14. The knitting element 1 may also comprise the rotor 2B or the rotor 2C, instead of the rotor 2. The knitting element may also comprise other rotors. The knitting element 1 can be used in the knitting of other items, apart from socks.

The outer plates 12 are plate-shaped and sandwich and hold the rotor 2 from either side in the axial direction L1. The outer plates 12 are formed in such a manner that the vertical direction in the drawings is the longitudinal direction of the plates.

The inner plates 13, 14 are plate-shaped and sandwich and hold the rotor 2 from either side in the vertical direction in the drawings. The inner plates 13, 14 are arranged in a separated fashion in the vertical direction in the drawings, on either side of the rotor 2. The inner plates 13, 14 are sandwiched and supported by the pair of outer plates 12 (supporting plates) from either side in the axial direction L1.

In the knitting element 1, the outer plate 12, the inner plates 13, 14 and the outer plate 12 are layered together and fixed in the direction of the plate thickness. The inner plate 13 is bonded to the adjacent outer plates 12 by welding, or the like. The inner plate 14 is bonded to the adjacent outer plates 12 by welding, or the like. In the knitting element 1, the outer plate 12, the inner plates 13, 14 and the outer plate 12 are integrated together to form a thin plate shape.

The lower end face 13*a* of the inner plate 13 opposes the circumferential surface 2*b* of the rotor 2 and functions as a sliding surface which rotatably supports the rotor 2. The upper end face 14*a* of the inner plate 14 opposes the circumferential surface 2*b* of the rotor 2 and functions as a sliding surface which rotatably supports the rotor 2. The inner plates 13, 14 function as a pair of bearing plates which are separate in the radial direction of the rotor 2 and which slidably support the circumferential surface of the rotor 2.

An opening section 12*a* passing in the plate thickness direction is formed in each outer plate 12. As shown in FIG. 4, this opening section 12*a* is formed from one end portion in the width direction W of the outer plate 12, towards the opposite side. The outer plate 12 is not opened on the side of the other end portion in the width direction W. The outer plate 12 is formed continuously in the vertical direction in the drawings, on the side of the other end portion. Furthermore, the opening section 12*a* is formed in a circular arc shape on the side of the other end portion in the width direction W.

The opening section 12*a* (knitting yarn introduction slot) functions as a passage through which a knitting yarn enters a hook 22 of the rotor 2, and also functions as a passage through which a knitting yarn that has been captured by a hook 22 exits to the exterior. Furthermore, the circular arc shape of the opening section 12*a* forms a guide portion for causing a knitting yarn captured by a hook 22 to perform a circular movement about the prescribed axis of rotation L1. More specifically, a knitting yarn which is situated in the space surrounded by a hook 22 and the opening section 12*a* , performs a circular movement about the prescribed axis of rotation L1 in accordance with the rotational movement of the hook 22.

When the rotor 2 is in an installed state in the knitting element 1, the rotor 2 is exposed to the outer side of the outer plates 12 in the width direction W. More specifically, the rotor teeth 21 of the rotor 2 are exposed on the outer side.

(Method of Driving Rotor)

Figure 7:
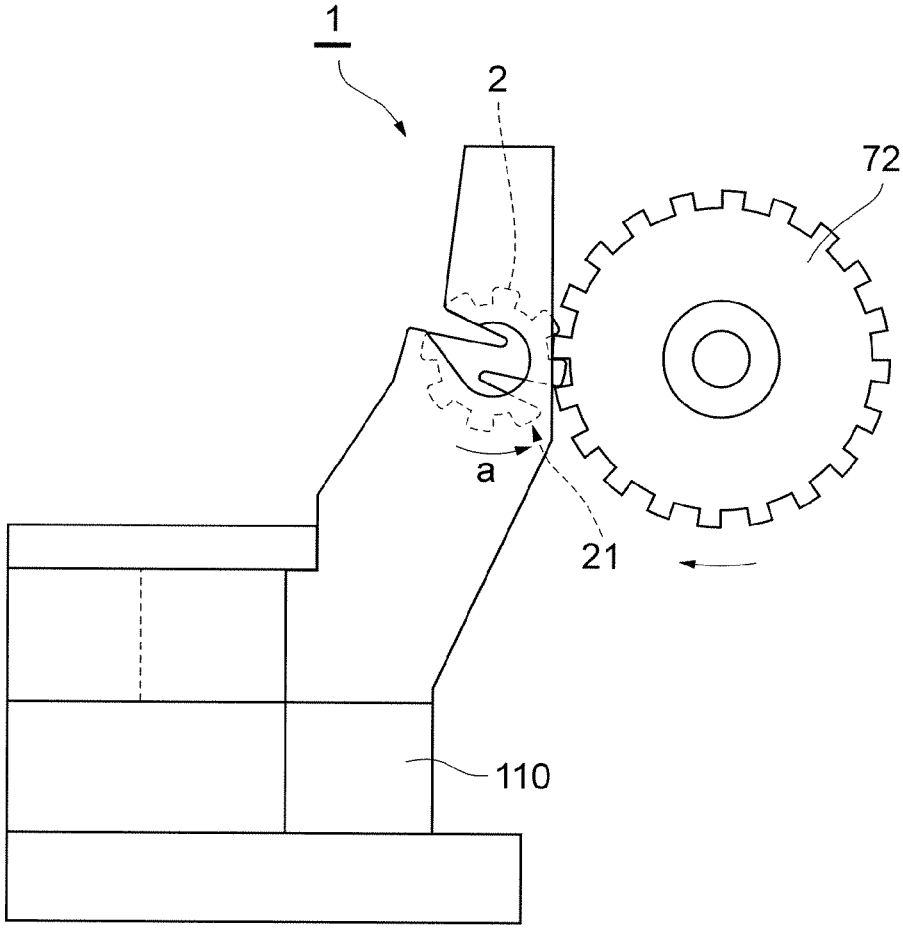
FIG. 7 is a side face diagram showing a holder base of a circular knitting machine and a knitting element which is fixed to a holder base, and a drive gear wheel which drives the rotor of the knitting element.
Figure 8:
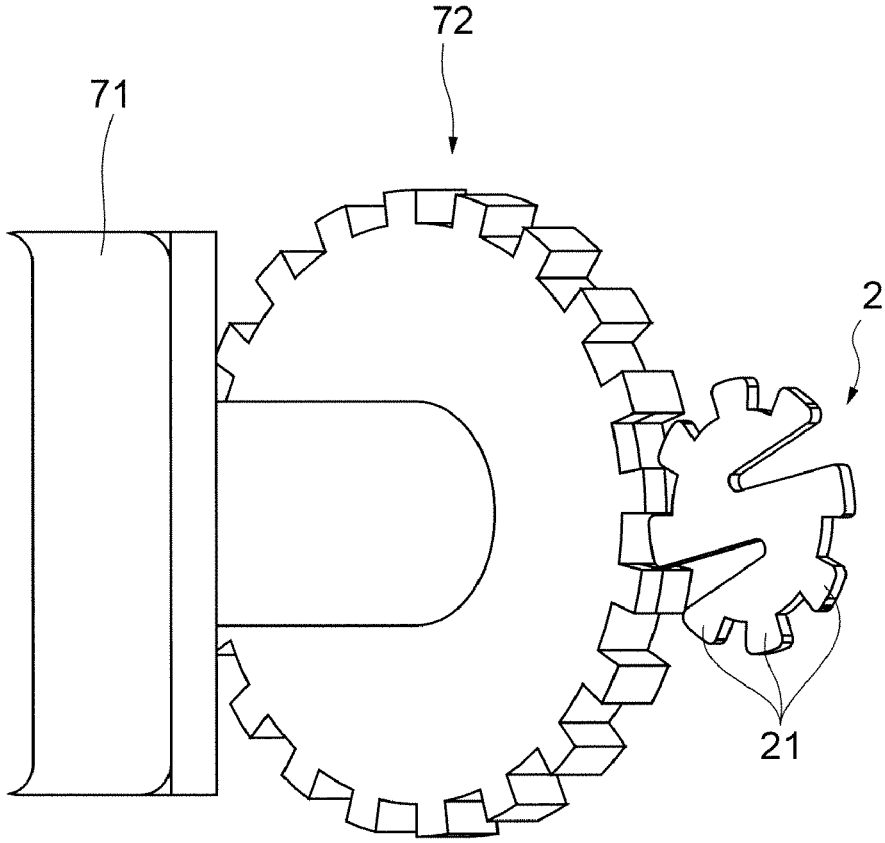
FIG. 8 is a schematic drawing showing a rotor, a drive gear wheel which meshes with the rotor, and a servo motor which drives the drive gear wheel.

FIG. 7 is a side face diagram showing a holder base of a circular knitting machine and a knitting element which is fixed to a holder base, and a drive gear wheel which drives the rotor of the knitting element. FIG. 8 is a schematic drawing showing a rotor, a drive gear wheel which meshes with the rotor, and a servo motor which drives the drive gear wheel.

As shown in FIG. 7, the knitting element 1 is used by being installed on the holder base 110 of the circular knitting machine 100, for example. The drive gear wheel 72 is arranged on the outer circumference side of the holder base 110. The drive gear wheel 72 is fixed to the output shaft of the servo motor 71 shown in FIG. 8. The drive gear wheel 72 meshes with the rotor teeth 21 formed in the circumference edge portion of the rotor 2 and transmits the drive force produced by the servo motor 71 to the rotor 2, thereby driving the rotor 2 to rotate.

(Knitting Method Using Rotor: Flat Knitting)

Figure 9:
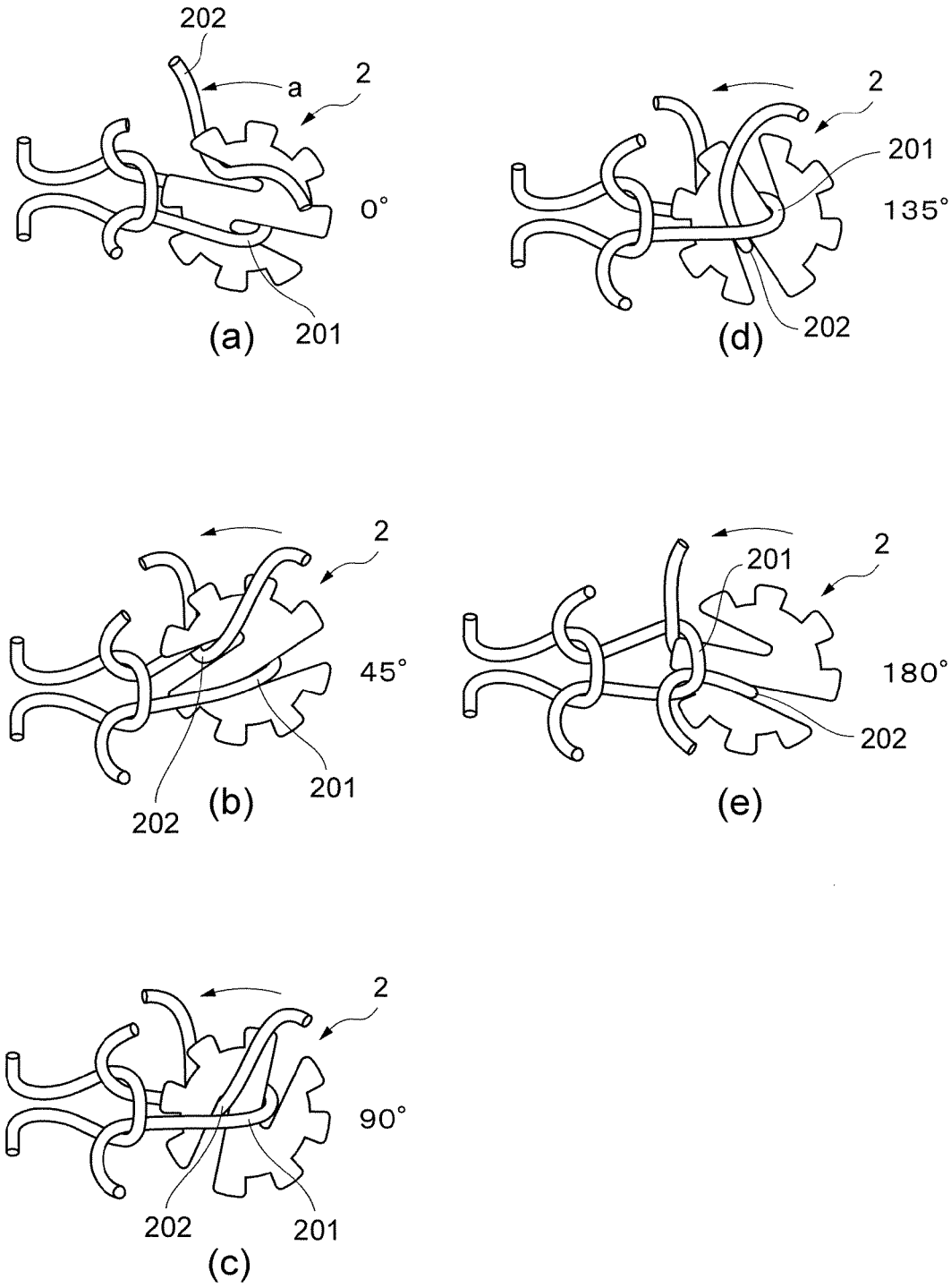
FIG. 9 is a diagram showing a knitting cycle in a case where flat knitting is carried out using a rotor relating to an embodiment of the present invention.

Now, a knitting cycle based on a rotary principle will be described. FIG. 9 is a diagram showing a knitting cycle in a case where flat knitting is carried out using a rotor relating to an embodiment of the present invention. The rotor 2 rotates in the direction of arrow a (leftwards in the drawings).

In this description, the position of the rotor 2 shown in (a) of FIG. 9 is taken as a reference position (0 degrees). When the rotor 2 is in the 0 degree position (reference position), a knitting yarn 202 is supplied to the rotor 2. In this case, an old loop 201 is in an engaged state in the lower side hook 22.

When the rotor 2 rotates a further 45 degrees from the 45 degree position shown in (b) of FIG. 9, the rotor 2 assumes the state shown in (c) of FIG. 9. When the rotor 2 is rotated to the 90 degree position from the 45 degree position, the knitting yarn 202 starts to pass through an old loop 201 while forming a new loop.

When the rotor 2 rotates a further 45 degrees from the 90 degree position shown in (c) of FIG. 9, the rotor 2 assumes the state shown in (d) of FIG. 9. When the rotor 2 rotates to the 135 degree position from the 90 degree position, the new loop 202 passes through the old loop 201.

When the rotor 2 rotates a further 45 degrees from the 135 degree position shown in (d) of FIG. 9, the rotor 2 assumes the state shown in (e) of FIG. 9. When the rotor 2 rotates to the 180 degree position from the 135 degree position, the old loop 201 is released from the hook 22. Consequently, the new loop 202 passes through the old loop 201 and a flat stitch is formed. One stitch (loop) is formed when the rotor 2 rotates through 180 degrees.

(Knitting Method Using Rotor: Float Knitting)

Figure 10:
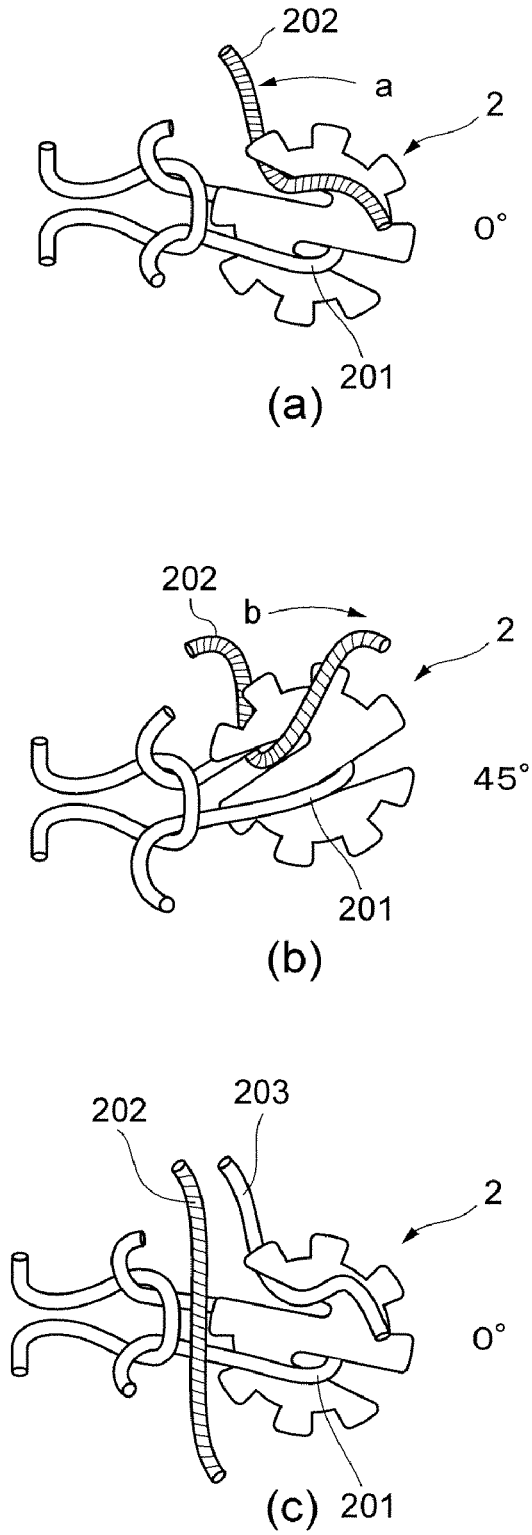
FIG. 10 is a diagram showing a knitting cycle in a case where float knitting is carried out using a rotor relating to an embodiment of the present invention.
Figure 11:
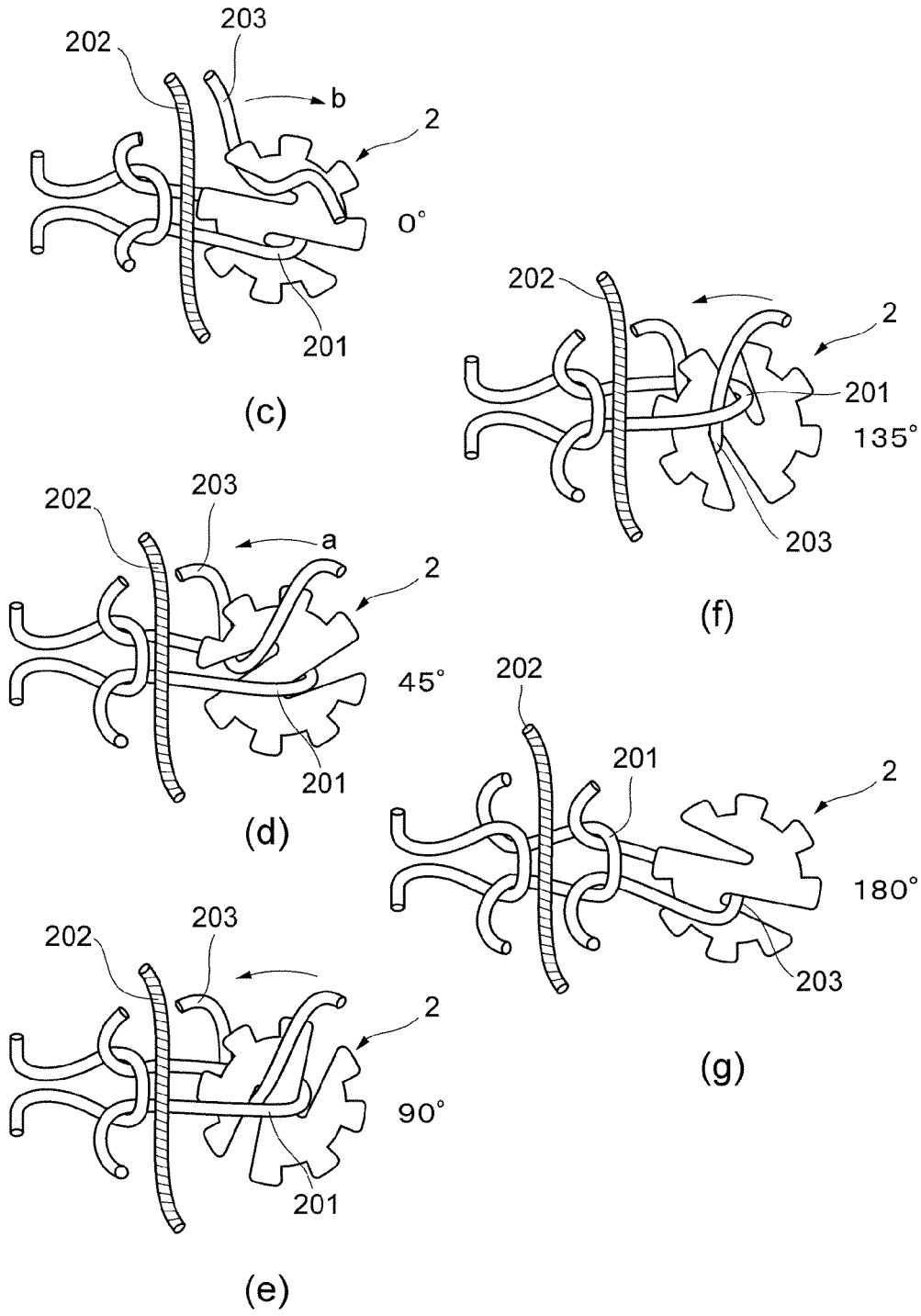
FIG. 11 is a diagram showing a knitting cycle in a case where float knitting is carried out using a rotor relating to an embodiment of the present invention.

FIGS. 10 and 11 are diagrams showing a knitting cycle in a case where float knitting is carried out using a rotor relating to an embodiment of the present invention. As shown in (a) of FIG. 10, when the rotor 2 is in the 0 degree position (reference position), a knitting yarn 202 is supplied to the rotor 2. In this case, an old loop 201 is in an engaged state in the lower side hook 22.

When the rotor 2 rotates through 45 degrees from the 0 degree position in a state where a knitting yarn 202 is captured in the hook 22, then the rotor 2 assumes the state shown in (b) of FIG. 10.

When the rotor 2 rotates 45 degrees in the direction of arrow b (rightwards in the drawings) from the 45 degree position shown in (b) of FIG. 10, the rotor 2 assumes the state shown in (c) of FIG. 10. When the rotor 2 rotates in reverse from the 45 degree position to the 0 degree position, the knitting yarn 202 is released from the hook 22.

When the rotor 2 returns to the 0 degree position, as shown in (c) of FIG. 11, a knitting yarn 203 is supplied to the rotor 2. In this case, the old loop 201 remains in an engaged state in the lower side hook 22.

The rotor 2 then rotates through 180 degrees in the direction of arrow a, from the 0 degree position shown in (c) of FIG. 11, and similarly to the plain knitting described above, a new loop 203 is passed inside the old loop 201 and one stitch is formed. In this case, the knitting yarn 202 is in a unknitted state, in other words, it is floating.

(Knitting Method Using Rotor: Tuck Knitting)

Figure 12:
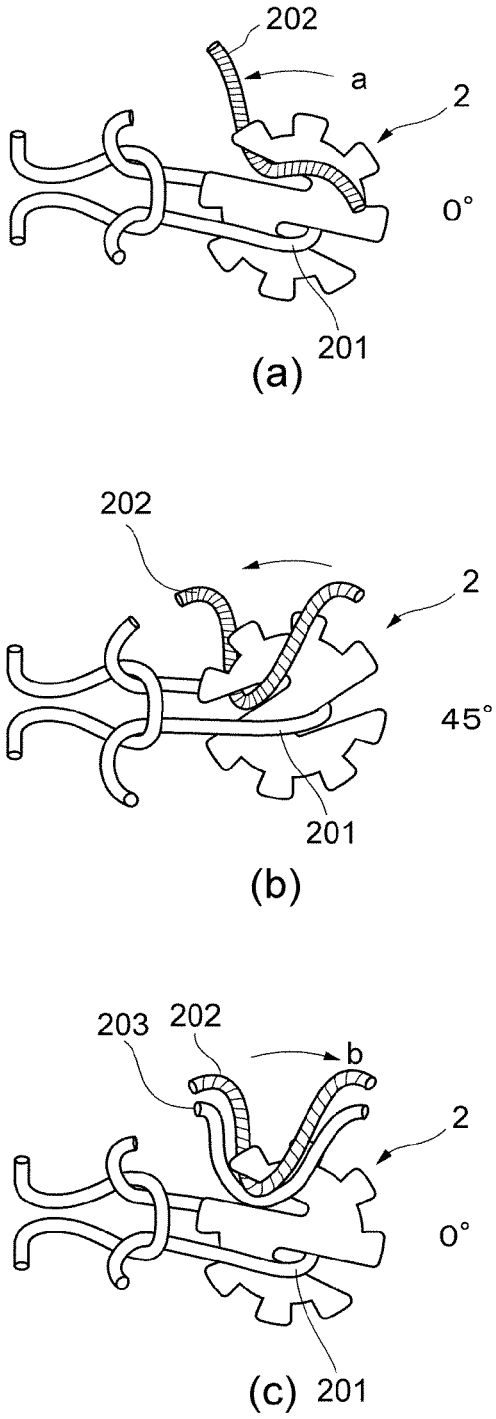
FIG. 12 is a diagram showing a knitting cycle in a case where tuck knitting is carried out using a rotor relating to an embodiment of the present invention.
Figure 13:
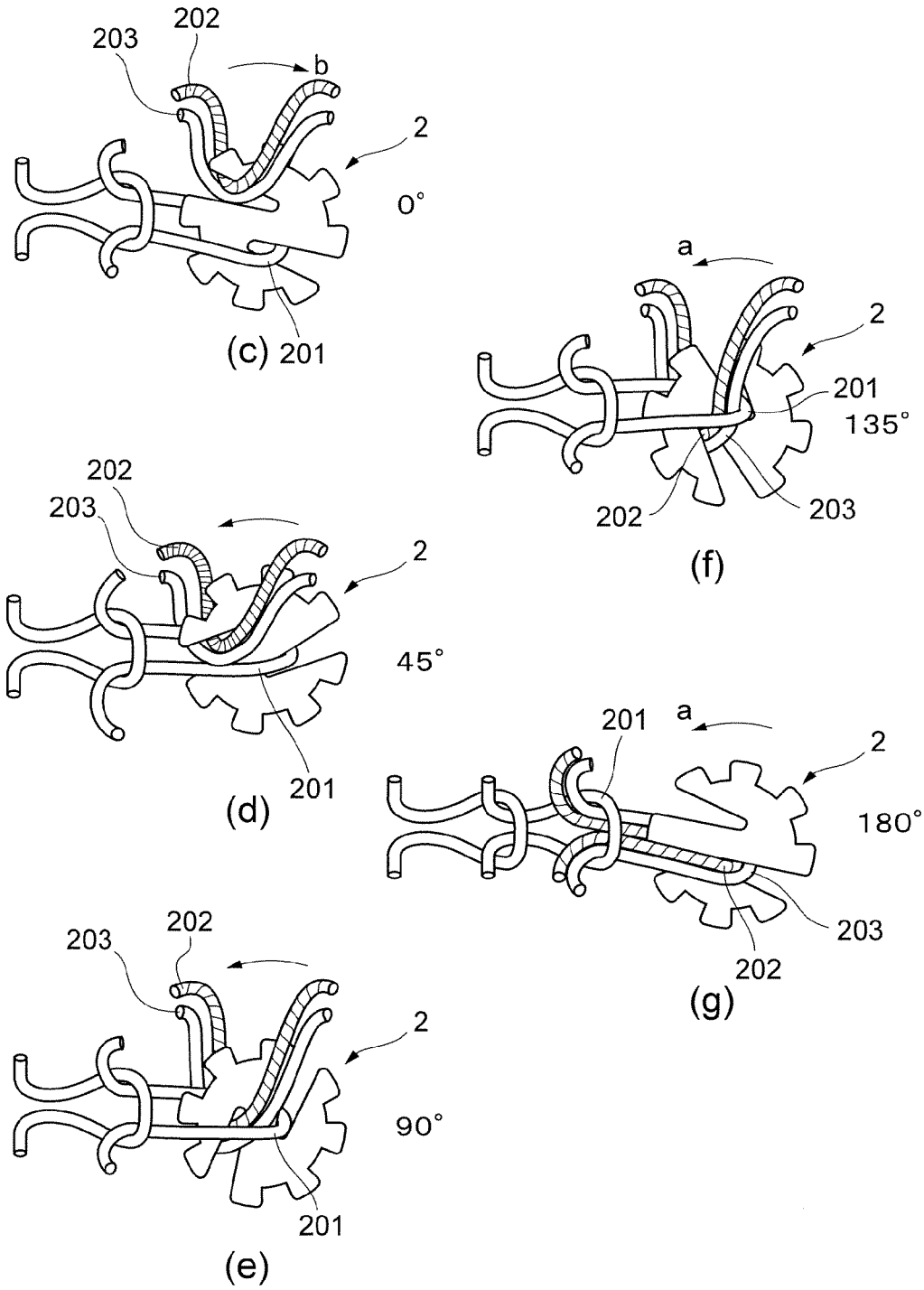
FIG. 13 is a diagram showing a knitting cycle in a case where tuck knitting is carried out using a rotor relating to an embodiment of the present invention.

FIGS. 12 and 13 are diagrams showing a knitting cycle in a case where tuck knitting is carried out using a rotor relating to an embodiment of the present invention. As shown in (a) of FIG. 12, when the rotor 2 is in the 0 degree position (reference position), a knitting yarn 202 is supplied to the rotor 2. In this case, an old loop 201 is in an engaged state in the lower side hook 22.

When the rotor 2 rotates through 45 degrees from the 0 degree position in a state where a knitting yarn 202 is captured in the hook 22, then the rotor 2 assumes the state shown in (b) of FIG. 12.

When the rotor 2 rotates 45 degrees in the direction of arrow b (rightwards in the drawings) from the 45 degree position shown in (b) of FIG. 12, the rotor 2 assumes the state shown in (c) of FIG. 12. When the rotor 2 rotates in reverse from the 45 degree position to the 0 degree position, the knitting yarn 202 remains captured by the hook 22.

As shown in (c) of FIG. 13, when the rotor 2 returns to the 0 degree position, a knitting yarn 203 is supplied to the rotor 2 and the knitting yarns 202, 203 are in a captured state in the upper side hook 22. In this case, the old loop 201 remains in an engaged state in the lower side hook 22.

The rotor 2 then rotates through 180 degrees in the direction of arrow a, from the 0 degree position shown in (c) of FIG. 13, and new loops 202, 203 pass together inside the old loop 201 and a stitch is formed. In this way, by knitting together a knitting yarn 202 of a first course and a knitting yarn 203 of a second course, it is possible to form a tuck stitch.

If the direction of rotation of the rotor 2 (a direction, b direction) is changed, then this can be achieved easily using a servo motor 71. By changing the electrical signal instructions supplied to the servo motor 71, it is possible to change the angle of rotation and the direction of rotation of the rotor 2, as desired. The fact that the direction of rotation of the rotor 2 is changed is a major characteristic feature of driving with a servo motor.

(Knitting Method Using Pile Rotor: Pile Knitting)

Figure 14:
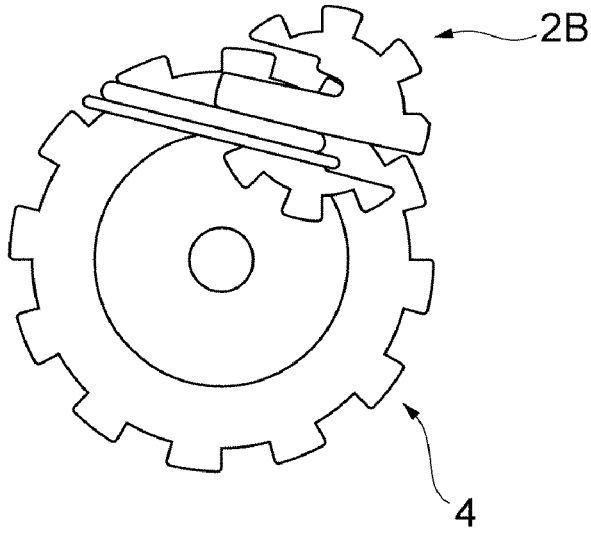
FIG. 14 is a side view diagram showing an arrangement of a pile rotor and a sinker.
Figure 15:
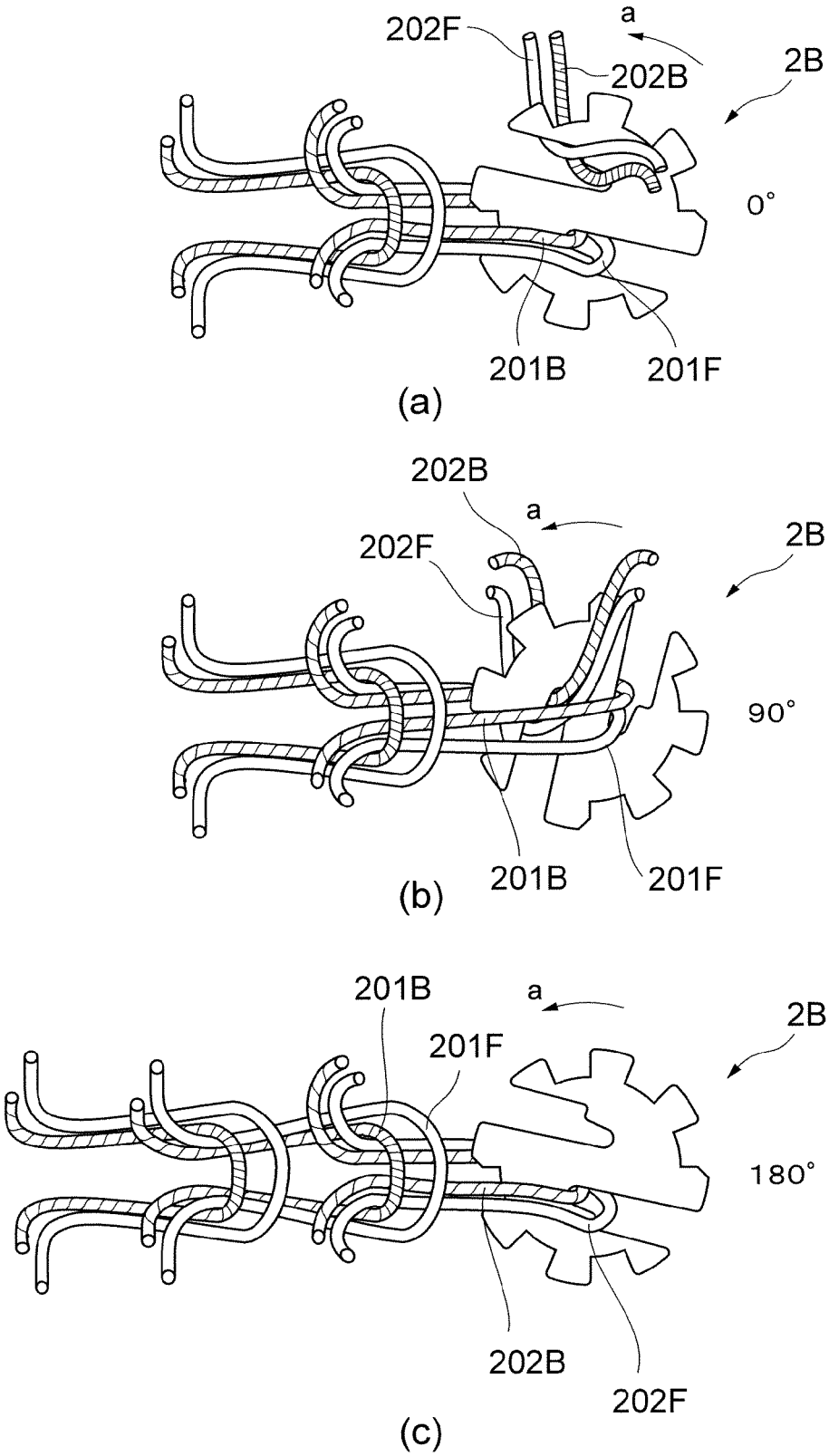
FIG. 15 is a diagram showing a knitting cycle in a case where pile knitting is carried out using a pile rotor relating to an embodiment of the present invention.

FIG. 14 is a side view diagram showing an arrangement of a pile rotor and a sinker. FIG. 15 is a diagram showing a knitting cycle in a case where pile knitting is carried out using a pile rotor relating to an embodiment of the present invention.

As shown in (a) of FIG. 15, when the rotor 2B is in the 0 degree position (reference position), knitting yarns 202F, 202B are supplied to the rotor 2B. The knitting yarn 202F is engaged by the first step hook (the bottom section of the engaging recess section) 24 of the rotor 2B and the knitting yarn 202B is engaged by the second step hook (the bottom section of the engaging recess section) 23 of the rotor 2B. In this case, old loops 201F, 201B are in a captured state in the lower side hook 22B.

The pile rotor 2B then rotates through 180 degrees in the direction of arrow a, from the 0 degree position shown in (a) of FIG. 15, and new loops 202F, 202B pass together inside the old loops 201F, 201B and a stitch is formed. In this, the length of the stitch formed is different in the knitting yarn 202F engaged by the first step hook 24 and the knitting yarn 202B engaged by the second step hook 23. More specifically, the stitch formed by the knitting yarn 202F is longer than the stitch formed by the knitting yarn 202B.

Figure 16:
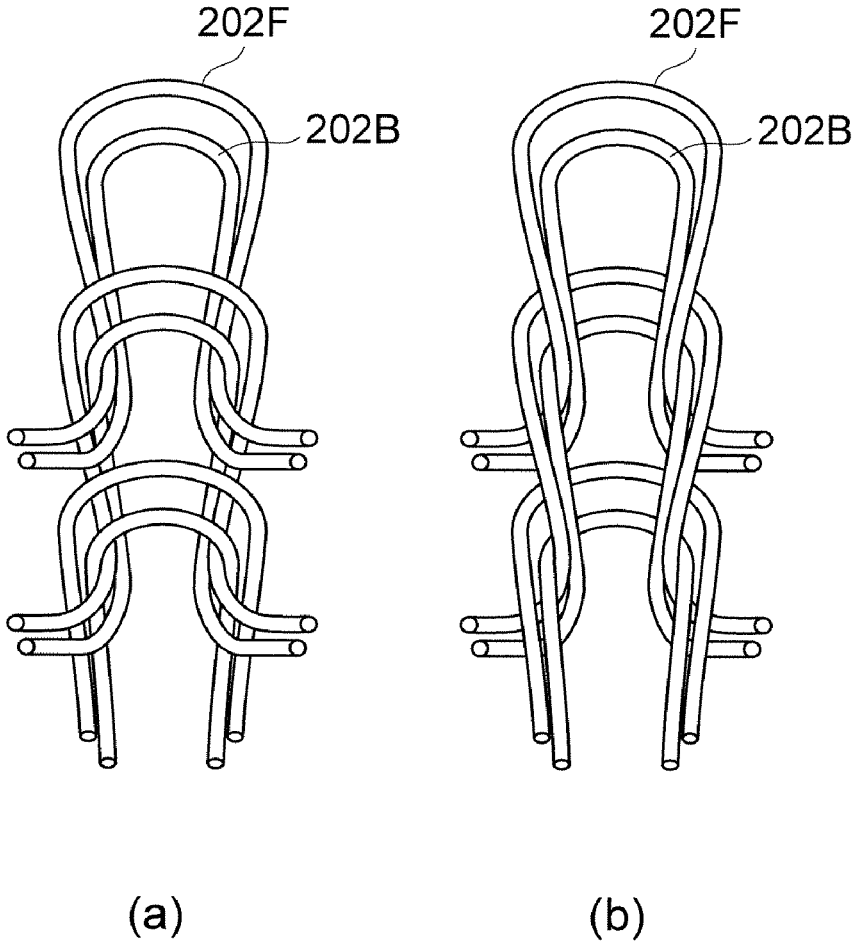
FIG. 16 is a diagram showing pile knitting formed by the knitting cycle shown in FIG. 15.

FIG. 16 is a diagram showing pile knitting formed by the knitting cycle shown in FIG. 15. (a) of FIG. 16 shows a rear side and (b) of FIG. 16 shows a front side. As shown in FIG. 16, the loop (pile loop) formed by the knitting yarn 202F is longer than the loop formed by the knitting yarn 202B. In a knitting method using the knitting cycle shown in FIG. 15, in contrast to conventional pile knitting (pile knitting using a sinker loop), the rotor loop (which corresponds to the needle loop with conventional knitting yarn) forms a pile.

(Rotary Sinker)

Figure 17:
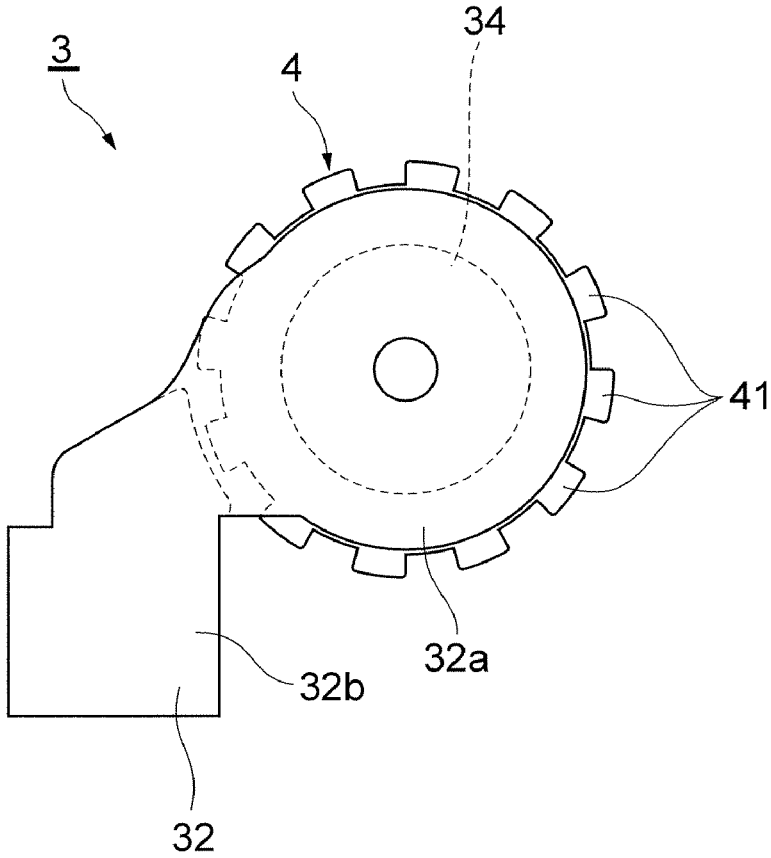
FIG. 17 is a side view diagram of a rotary sinker.
Figure 18:
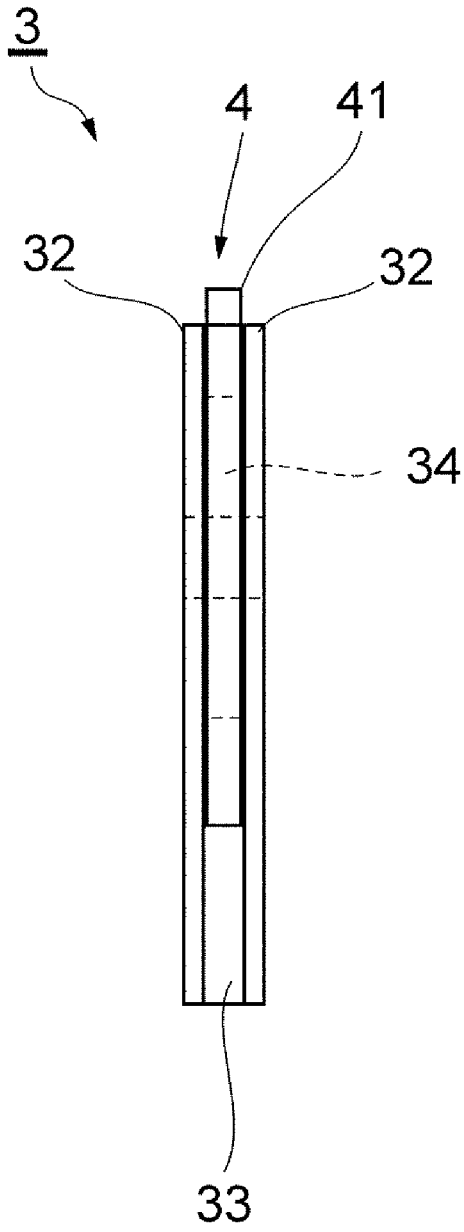
FIG. 18 is a front view diagram of a rotary sinker.
Figure 19:
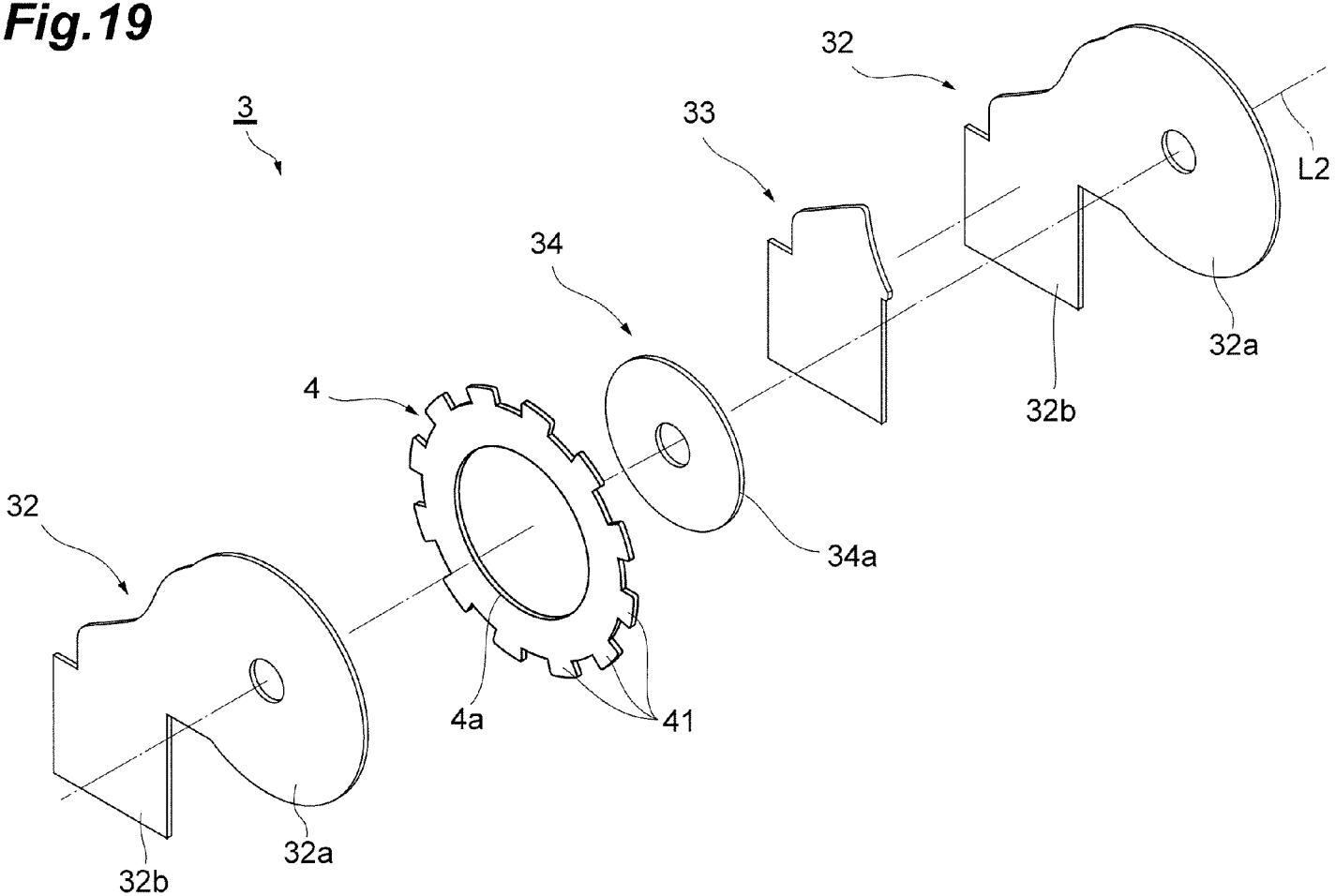
FIG. 19 is an exploded perspective diagram of a rotary sinker.

Next, a rotary sinker will be described. FIG. 17 to FIG. 19 are diagrams showing a rotary sinker. In the description of the rotary sinker 3, when the rotary sinker 3 is mounted on a circular knitting machine 100, the surface facing towards the center of the knitting machine 100 is taken to be the rear face of rotary sinker, and the surface facing toward the outside of the knitting machine 100 is taken to be the front face of the rotary sinker.

The rotary sinker 3 (rotational sinker) which is shown in FIG. 17 to FIG. 19 is mounted on a circular knitting machine 100, for example, and is used in the knitting of socks, and the like. The rotary sinker 3 comprises a ring sinker (rotor) 4, outer plates 32, an inner plate 33 and a sinker axle 34.

The ring sinker 4 is made from a flat plate and is foamed in a ring shape (circular ring shape). The ring sinker 4 is mounted in the rotary sinker 3 and is rotatable about a prescribed axis of rotation L2.

Sinker teeth 41 for transmitting drive force to the ring sinker 4 are provided on the circumference edge portion of the rotary sinker 4. The sinker teeth 41 are arranged equidistantly about the whole circumference. In the ring sinker 4 according to the present embodiment, there are twelve teeth. The rotor teeth 41 mesh with the gear which is provided on the output shaft of a ring sinker drive motor, whereby drive force is applied thereto and the ring sinker 4 turns about the axis of rotation L2. In the present embodiment, there are twelve teeth on the ring sinker 4, but the number of teeth on the ring sinker 4 is not limited to twelve.

Furthermore, the inner circumferential surface 4*a* of the ring sinker 4 functions as a sliding surface when the ring sinker 4 rotates. The ring sinker 4 is supported rotatably by the sinker axle 34 and the outer plates 32.

Furthermore, the sinker teeth 41 of the ring sinker 4 also function as engaging sections which hold sinker loops, as well as having a function of transmitting drive force. A conventional sinker performs an action for assisting the knitting operation by performing a reciprocal movement, but the ring sinker 4 uses a rotational movement and therefore has a different function to a conventional sinker and serves to hold a sinker loop and to transmit drive force.

The outer plates 32 are plate-shaped and sandwich and hold the ring sinker 4 from either side in the axial direction L2. The outer plates 32 each have a circular section 32*a* which covers the ring sinker 4, and a fixing section 32*b* which is formed continuously with the circular section 32*a*. As shown in FIG. 17, the sinker teeth 41 of the ring sinker 4 extend to the outside of the external shape of the circular section 32*a*.

In side view, the outer plates 32 each comprise, in the circular section 32*a*, a first curve shape 32*c* which exposes the sinker teeth 41 to the exterior, and a second curve shape which has a larger radius of curvature than the first curve shape. The first curve shape 32*c* is formed continuously on the circumference edge of the circular section 32*a*, from the lower side, through the front side, to a position beyond the upper side.

The second curve shape 32*d* is formed on the rear surface side in the circumference edge of the circular section 32*a*. The radius of curvature of the second curve shape is formed so as to become gradually larger than the first radius of curvature of the first curve shape. More specifically, when the ring sinker 4 is rotated in the direction of arrow c, the sinker teeth 41 are exposed externally at the first curve shape 32*c*, and the sinker teeth 41 are gradually concealed inside the outer plates 32 at the second curve shape 32*d*. By this means, the knitting yarns 304 which have been engaged by the sinker teeth 41 exit from the sinker teeth 41 in the portion corresponding to the second curve shape (see FIG. 23).

The fixing section 32*b* is a portion which is inserted into a groove provided in the holder base 110. Furthermore, the fixing section 32*b* may have different widths in the opposing outer plates 32. By adopting a structure of this kind, it is possible to provide a step difference which extends in the direction of insertion. This step difference functions as a positioning step difference for the rotary sinker 3. Furthermore, this step difference is able to constrict the movement of the rotary sinker 3 in the radial direction of the holder base 110, when the rotary sinker 3 is installed on the holder base 110.

The sinker axle 34 is made from a flat plate and has a circular disk shape. The sinker axle 34 is accommodated in the opening section of the ring sinker 4 and is sandwiched and supported by outer plates 32 from either side in the axial direction L2. More specifically, the sinker axle 34 is sandwiched between the circular sections 32*a* of the outer plates 32. The outer diameter of the sinker axle 34 is formed so as to correspond to the size of the opening section of the ring sinker 4. The outer circumferential surface 34*a* of the sinker axle 34 functions as a sliding surface which abuts against the inner circumferential surface 4*a* of the ring sinker 4.

The inner plate 33 is formed in a plate shape and has the same thickness as the sinker axle 34. The inner plate 33 is sandwiched and supported by the pair of outer plates 32 from either side in the axial direction L2. More specifically, the inner plate 33 is sandwiched between the fixed sections 32*b* of the outer plates 32.

In the rotary sinker 3, the outer plate 32, the inner plate 33, the sinker axle 34 and the outer plate 32 are layered together and fixed in the direction of the plate thickness. The inner plate 33 is bonded to the fixing sections 32*b* of the adjacent outer plates 32 by welding, or the like. The sinker axle 34 is bonded to the circular sections 32*a* of the adjacent outer plates 32 by welding, or the like.

(Method of Driving Ring Sinker)

Figure 20:
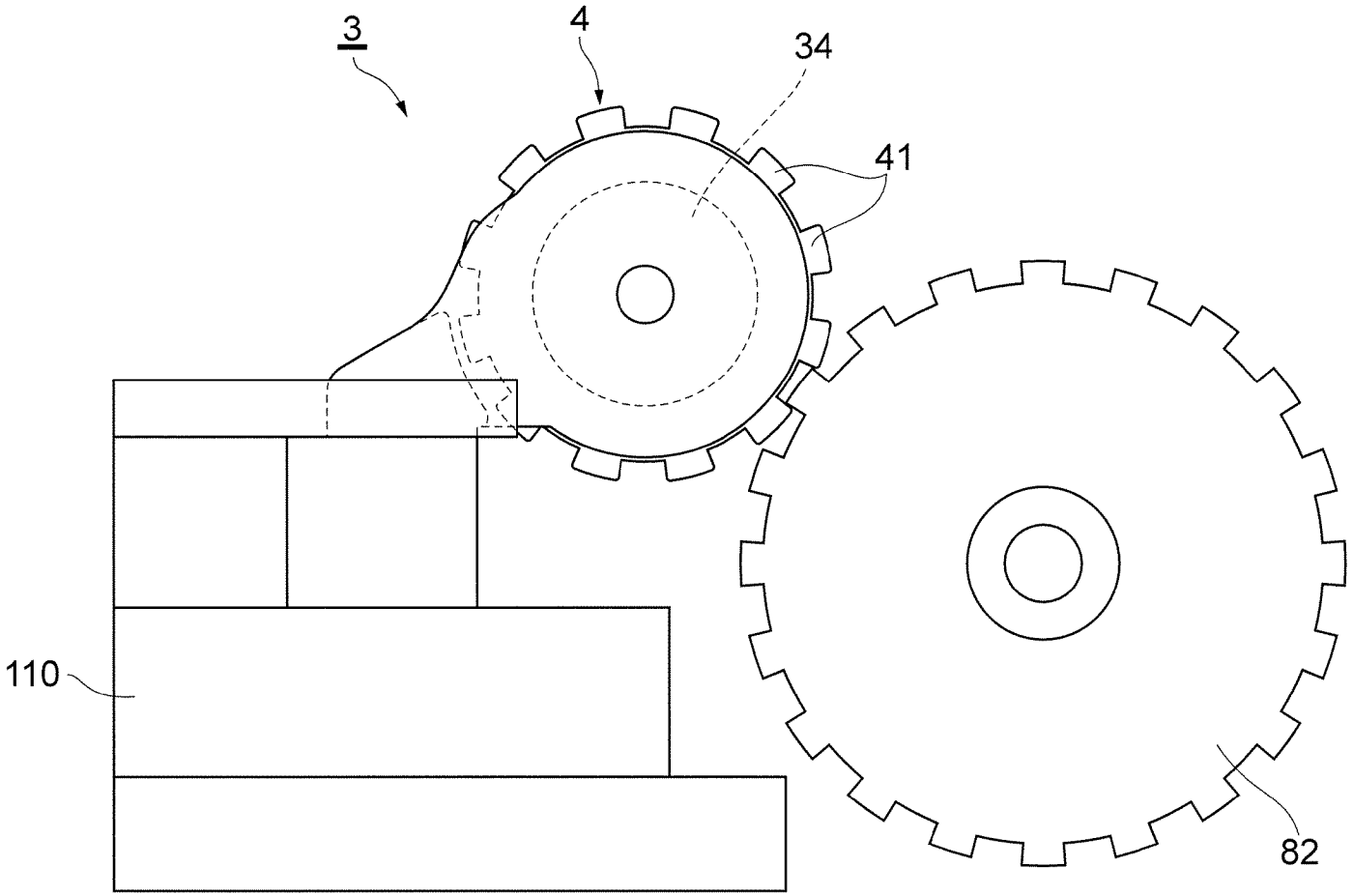
FIG. 20 is a side view diagram showing a holder base of a circular knitting machine and a rotary sinker which is fixed to a holder base, and a drive gear wheel which drives the ring sinker of the rotary sinker.
Figure 22:
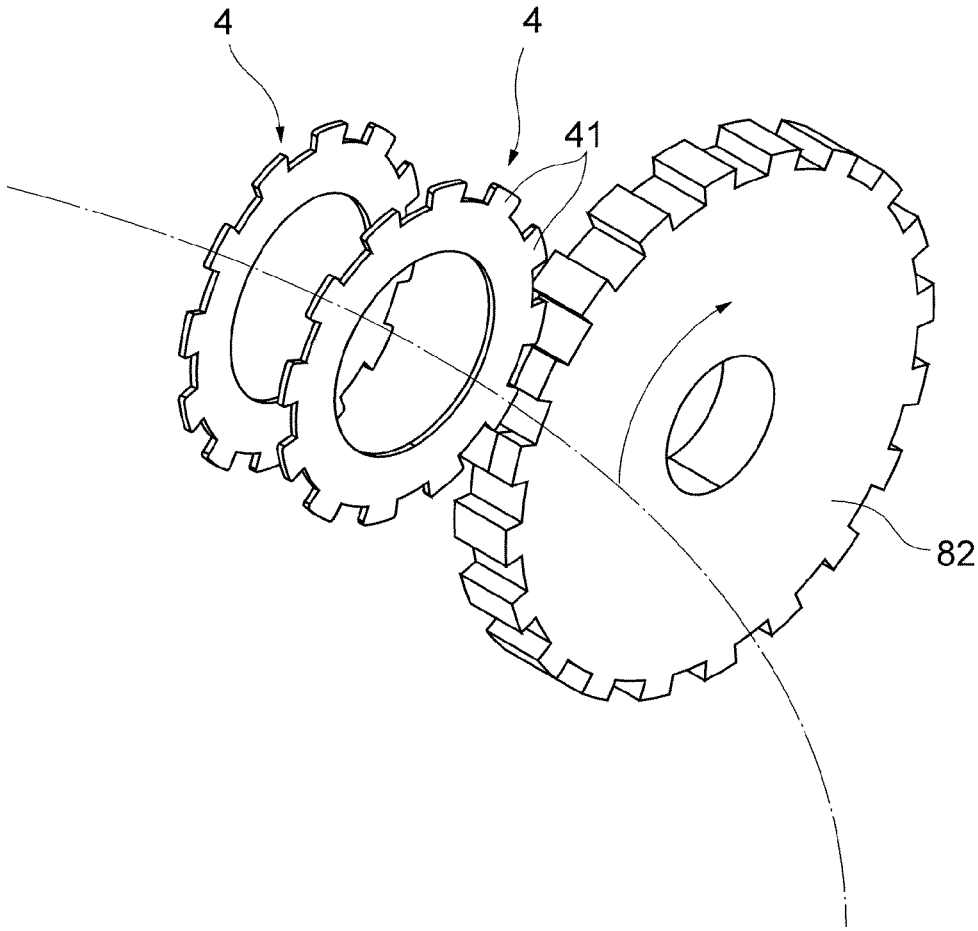
FIG. 22 is a perspective diagram showing a ring sinker and a drive gear wheel which meshes with the ring sinker.

FIG. 20 is a side face diagram showing a holder base of a circular knitting machine and a rotary sinker which is fixed to a holder base, and a drive gear wheel which drives the ring sinker of the rotary sinker. FIG. 22 is a perspective diagram showing a ring sinker and a drive gear wheel which meshes with the ring sinker.

As shown in FIG. 20, the rotary sinker 3 is used by being installed on the holder base 110 of a circular knitting machine 100, for example. The drive gear wheel 82 is arranged on the outer circumference side of the holder base 110. The drive gear wheel 82 is fixed to the output shaft of a servo motor for driving the ring sinker. The drive gear wheel 82 meshes with the sinker teeth 41 formed in the circumference edge portion of the ring sinker 4, transmits the drive force produced by the servo motor to the ring sinker 4, and thereby drives the ring sinker 4 to rotate.

(Arrangement of Rotor and Ring Sinker)

Figure 21:
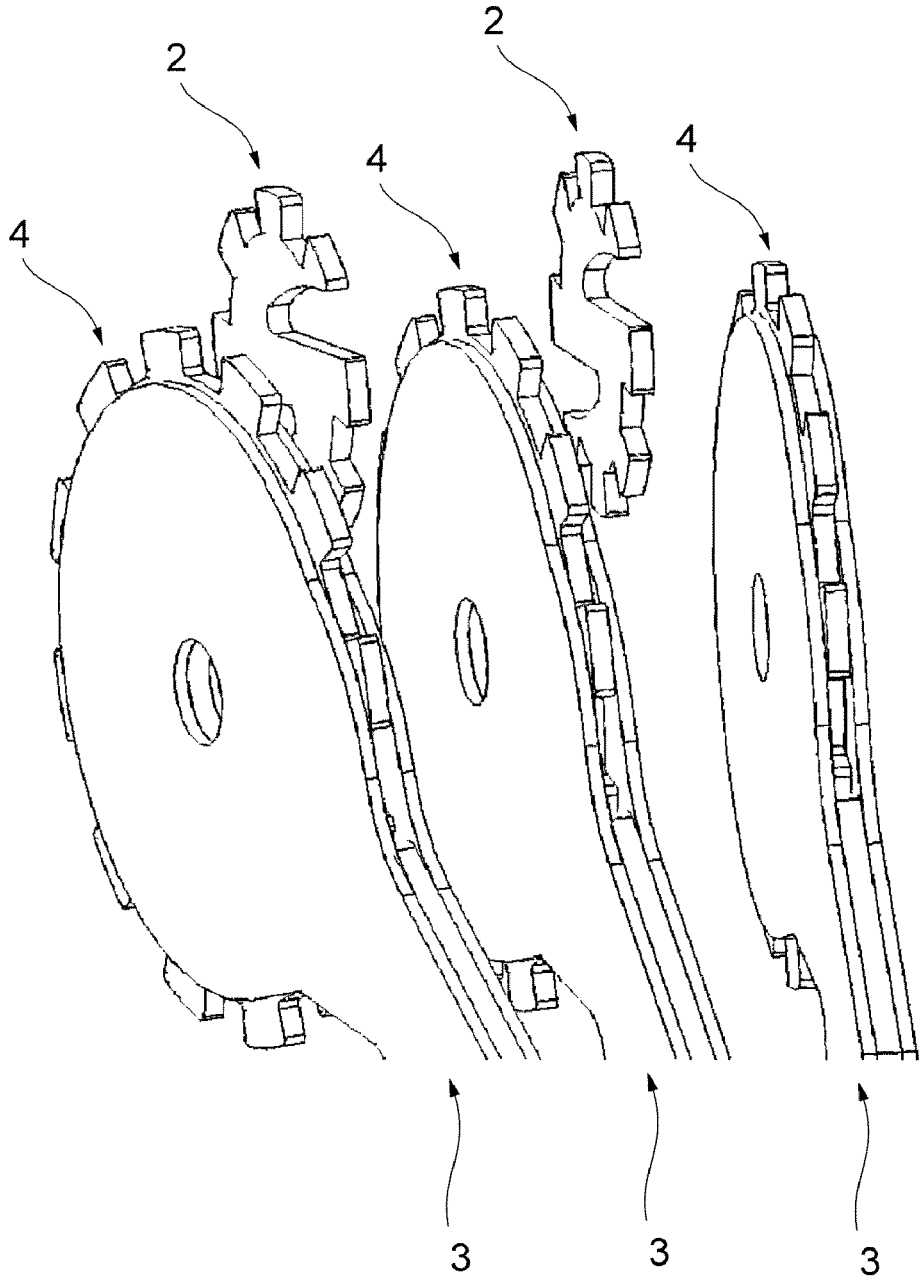
FIG. 21 is a schematic perspective drawing showing an arrangement of a rotor of a knitting element, and a rotary sinker.

FIG. 21 is a schematic perspective drawing showing an arrangement of a rotor of a knitting element, and a rotary sinker. The rotor 2 and the rotary sinker 3 (ring sinker 4) are arranged alternately in the circumferential direction of the holder base 110 when installed on the holder base 110 of a circular knitting machine 100, as shown in FIG. 21.

Figure 23:
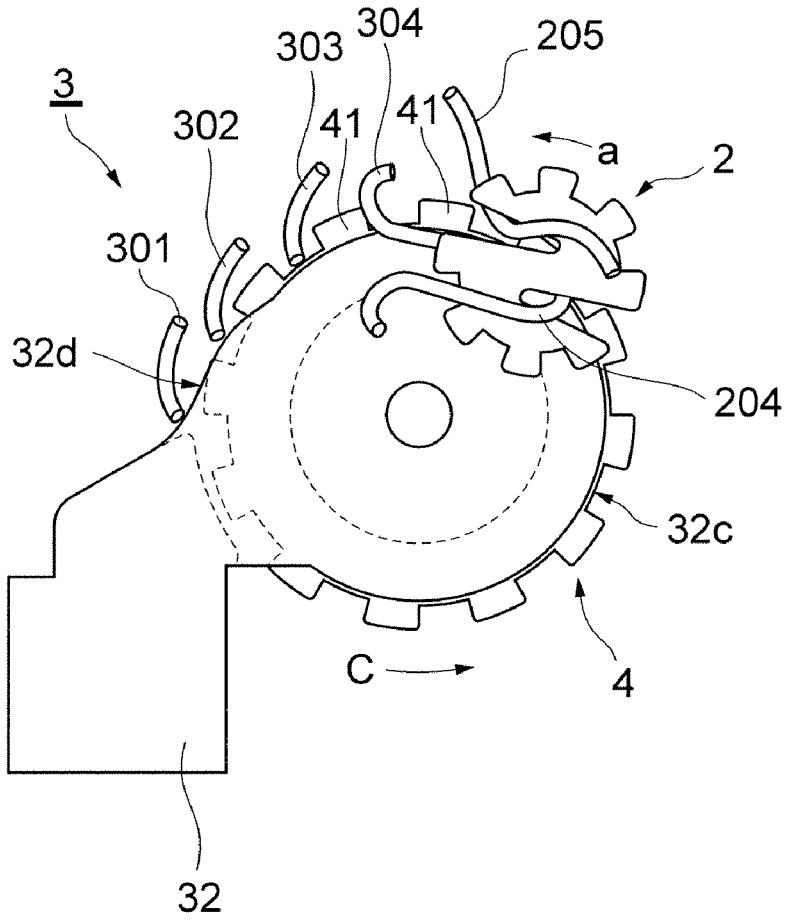
FIG. 23 is a side view diagram showing an arrangement of a rotor and a rotary sinker.
Figure 24:
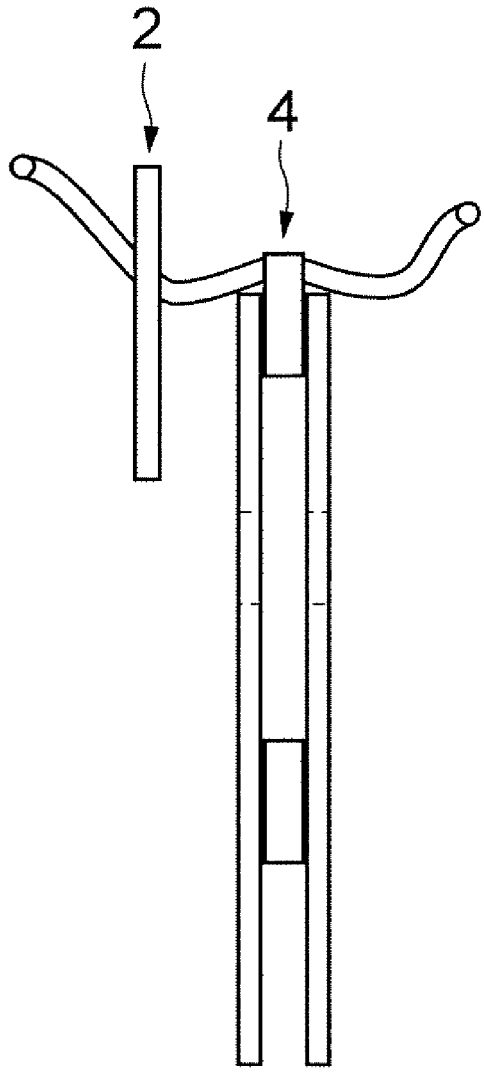
FIG. 24 is a front view diagram showing an arrangement of a rotor and a rotary sinker.

FIG. 23 and FIG. 24 are diagrams showing an arrangement of a rotor and a rotary sinker in a case where knitting is carried out using a rotor and a rotary sinker. As shown in FIG. 23, there is a prescribed interval in side view between the centers of the rotor 2 and the ring sinker 4. FIG. 23 shows a state where a sinker loop 304 is held by a sinker tooth 41.

The sinker loops 304, 303 are engaged by the sinker teeth 41, one loop in each tooth. The ring sinker 4 rotates in the direction of arrow c (leftwards in the drawing), and moves the sinker loop 304 leftwards in the drawing. The ring sinker 4 continues its rotation and sinker loops 302, 303, 304 are released from the sinker teeth 41 when the sinker teeth 41 are in a position concealed by the outer plates 32.

(Action of Ring Sinker)

Figure 25:
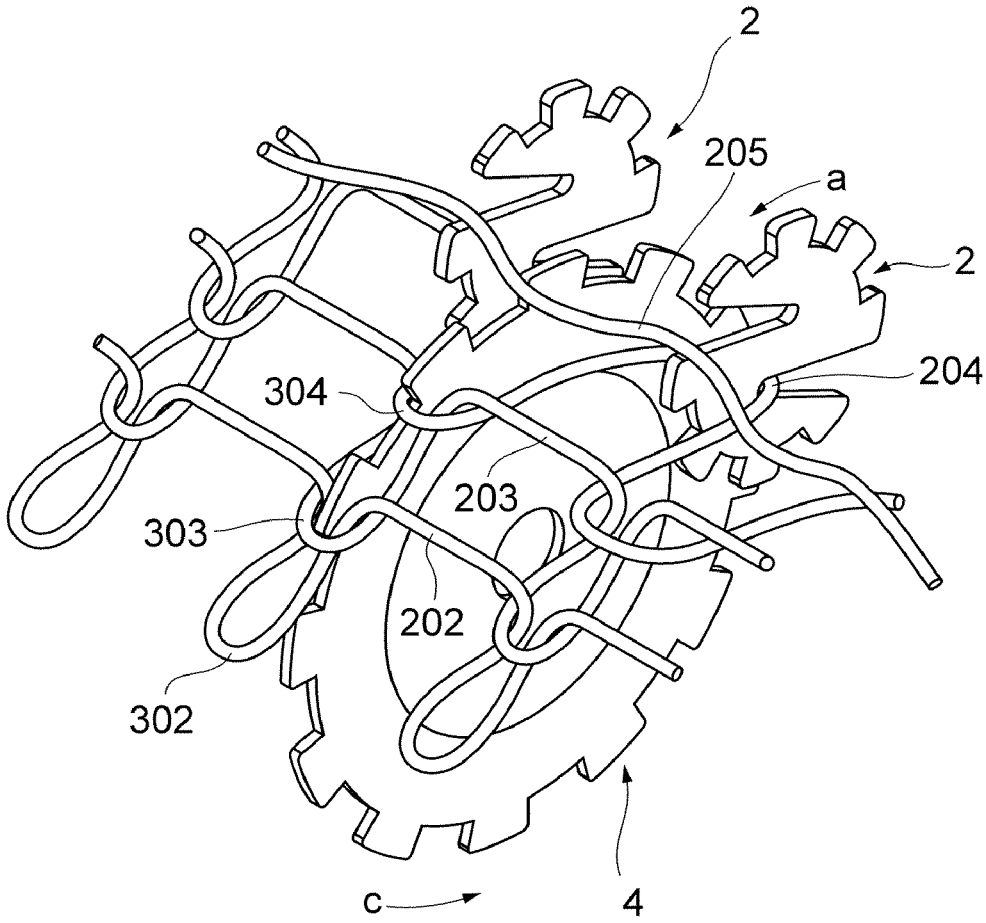
FIG. 25 is a schematic drawing showing a rotor, a ring sinker and stitches formed by same.

FIG. 25 is a schematic drawing showing a rotor, a ring sinker and stitches formed by same. As shown in FIG. 25, the sinker teeth 41 of the ring sinker 4 engage a knitting yarn 205. In this state, the rotor 2 turns in the direction of arrow a and a stitch is formed. Simultaneously with or subsequently to the rotation of the rotor 2, the ring sinker 4 rotates through a distance corresponding to one tooth (one of the sinker teeth 41), in the direction of arrow c.

The sinker teeth 41 which have moved by an amount corresponding to one tooth hold the sinker loop 304, as well as releasing the old loop 203 which has been formed by the rotor 2.

(Embodiment of Method of Driving Ring Sinker)

Figure 26:
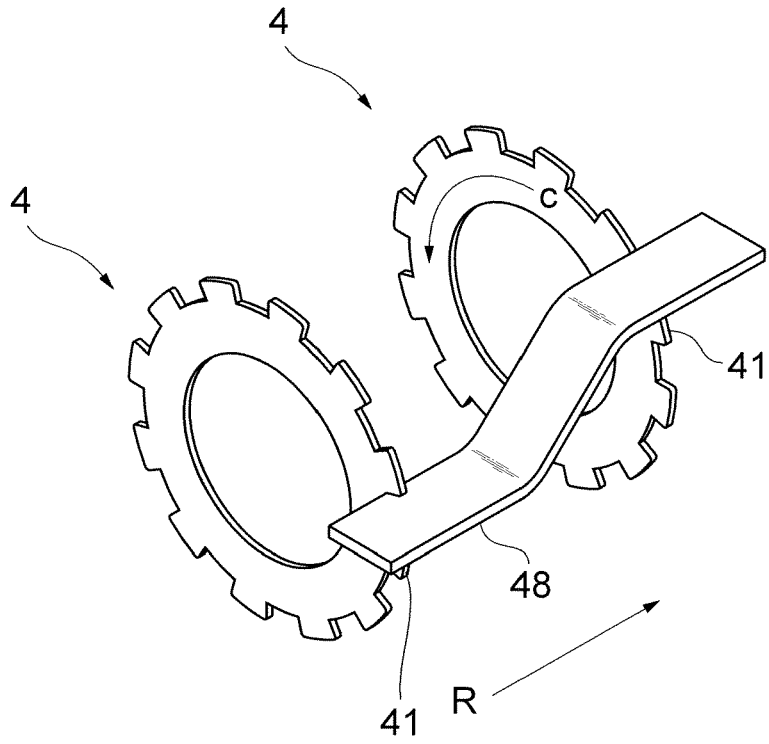
FIG. 26 is a perspective diagram showing a ring sinker, and a cam for driving rotation of the ring sinker.

FIG. 26 is a perspective diagram showing a ring sinker, and a cam for driving rotation of the ring sinker. As shown in FIG. 26, it is also possible to drive the ring sinker 4 to rotate using a cam 48. By moving the ring sinker 4 in the direction of arrow R, the position of the sinker tooth 41 engaging with the cam 48 is guided and the ring sinker 4 rotates in the direction of arrow c.

(Pile Sinker)

Figure 27:
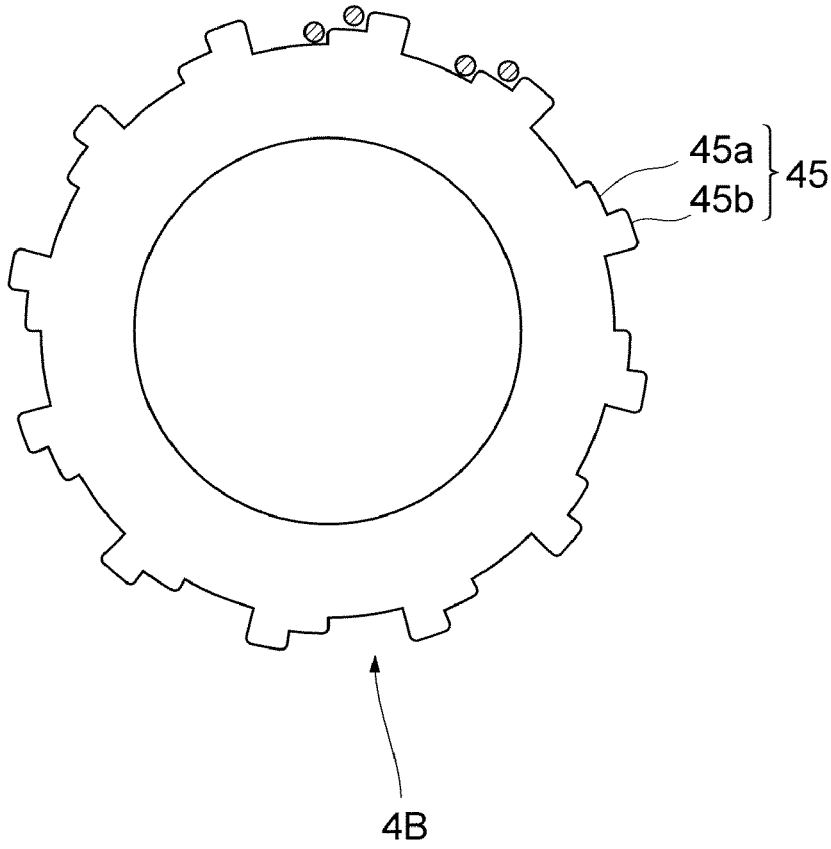
FIG. 27 is a side view diagram showing a pile sinker.

FIG. 27 is a side view diagram showing a pile sinker. A further mode of a ring sinker is a pile sinker 4B such as that shown in FIG. 27. The pile sinker 4B differs from the ring sinker 4 shown in FIG. 19 in that it comprises sinker teeth 45 having a step difference. These stepped sinker teeth 45 have a first-step sinker tooth 45*a* adjacently to the right of the recess section 42, and a second-step sinker tooth 45*b* adjacently to the right of the sinker 45*a*. The pile sinker 4B is used for pile knitting, and a needle thread (pile thread) is engaged by the first-step sinker tooth 45*a*, while a bobbin thread (ground knitting yarn) is engaged by the second-step sinker tooth 45*b*, thereby forming a pile stitch.

Figure 28:
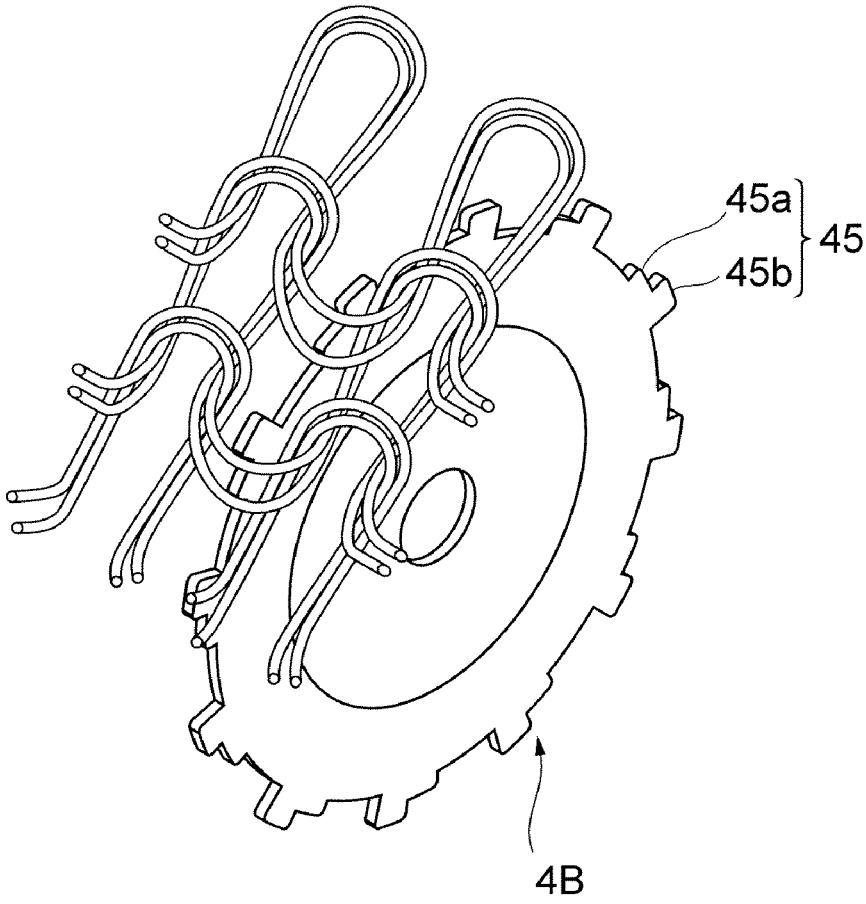
FIG. 28 is a perspective diagram showing a pile sinker and pile knitting formed using a pile sinker.

FIG. 28 is a perspective diagram showing a pile sinker and pile knitting formed using a pile sinker. FIG. 28 shows a state where a pile loop having a long loop and a sinker loop having a shorter loop than the pile loop are formed by the pile sinker 4B. The needle thread is engaged by the first-step sinker tooth 45*a* and the bobbin thread is engaged by the second-step sinker tooth 45*b*. By providing a step difference in the sinker teeth 45 in this way, it is possible to achieve a ring sinker which is suitable for pile knitting.

(Circular Knitting Machine)

Figure 29:
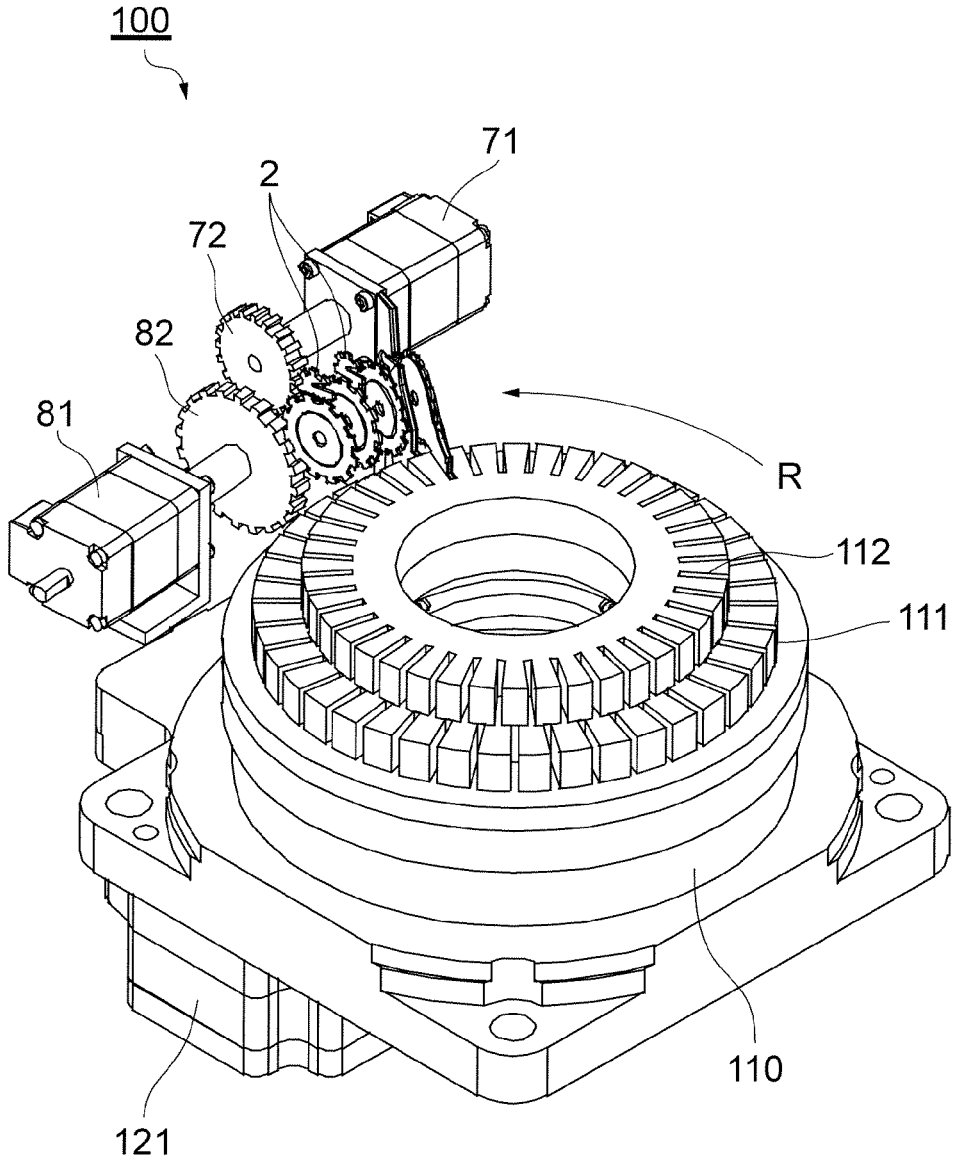
FIG. 29 is a perspective diagram showing a circular knitting machine relating to an embodiment of the present invention.

The knitting element relating to an embodiment of the present invention and a circular knitting machine comprising a rotary sinker are now described. FIG. 29 is a perspective diagram showing a circular knitting machine relating to an embodiment of the present invention. In FIG. 29, only a portion of the knitting element 1 and the rotary sinker 3 are depicted.

The circular knitting machine 100 relating to the embodiment of the present invention comprises: a knitting element 1 which performs knitting; a rotary sinker 3 which holds a knitting yarn that has been supplied to the knitting element 1; and a holder base (supporting platform) 110 which holds the knitting element 1 and the rotary sinker 3 and causes the knitting element 1 and the rotary sinker 3 to rotate about a second axis which extends in a second direction that is perpendicular to the first direction. The circular knitting machine 100 comprises one rotor driving servo motor 71, one ring sinker driving servo motor 81 and one holder base driving servo motor 121, respectively.

The holder base 110 is formed in a round cylindrical shape, and an element holding groove 111 for holding a knitting element 1, and a sinker holding groove 112 for holding a rotary sinker 3 are provided in the upper side end face of the holder base 110 as depicted in the drawings. The element holding groove 111 and the sinker holding groove 112 are formed alternately in the circumferential direction. A knitting element 1 is inserted into the element holding groove 111 and fixed to the holder base 110. A rotary sinker 3 is inserted into the sinker holding groove 112 and fixed to the holder base 110.

The rotor driving servo motor 71 drives rotation of the rotor 2 of the knitting element 1, and a drive gear wheel 72 is provided on the output shaft of the servo motor 71. This drive gear wheel 72 meshes with the rotor teeth 21 of the rotor 2 and drives the rotor 2 to rotate.

The ring sinker driving servo motor 81 drives rotation of the ring sinker 4 of the rotary sinker 3, and a drive gear wheel 82 is provided on the output shaft of the servo motor 81. This drive gear wheel 82 meshes with the rotor teeth 21 of the ring sinker 4 and drives the ring sinker 4 to rotate.

The holder base driving servo motor 121 drives the holder base 110 to rotate. Although not shown in the drawings, a drive gear wheel is provided on the output shaft of the servo motor 121, and this drive gear wheel meshes with a gear provided on the holder base 110 and drives to the holder base 110 to rotate. The holder base 110 is driven so as to rotate in the direction of arrow R.

Figure 30:
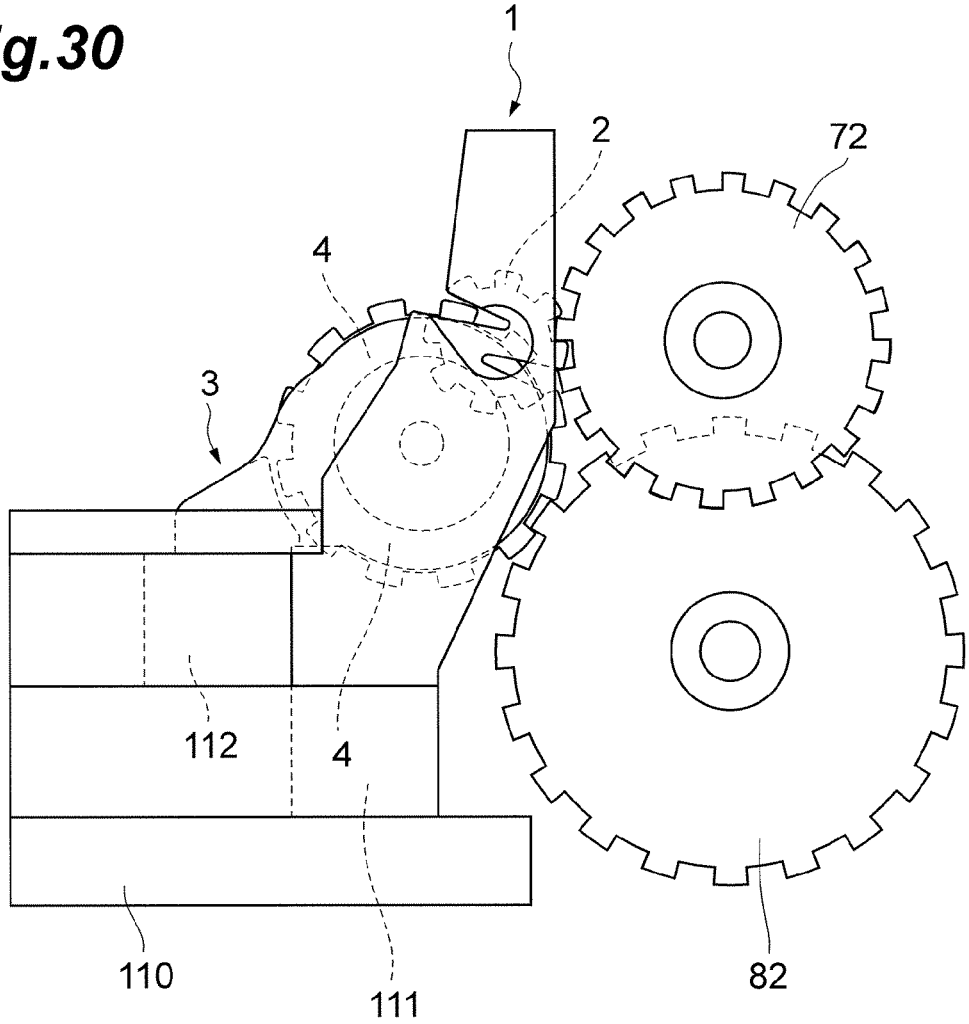
FIG. 30 is a side view diagram showing a holder base, a knitting element, a rotary sinker and a drive gear wheel.

FIG. 30 is a side view diagram showing a holder base, a knitting element, a rotary sinker and a drive gear wheel. As shown in FIG. 30, the holding groove 111 in which the knitting element 1 is installed is arranged to the outside of the holding groove 112 in which the rotary sinker 3 is installed, in the radial direction of the holder base 110.

Furthermore, the outer diameter of the rotor 2 is larger than the outer diameter of the ring sinker 4. When installed in the circular knitting machine 100, the center of the rotor 2 is disposed to the outside of the center of the ring sinker 4. Moreover, the center of the rotor 2 is disposed above the center of the ring sinker 4. The drive gear wheel 72 which meshes with the rotor 2 is disposed above the drive gear wheel 82 which meshes with the ring sinker 4. A composition may also be adopted in which the holding groove 111 is arranged to the inside of the holding groove 112, in the radial direction of the holder base 110.

As shown in FIG. 30, in the knitting element 1, the lower side portion which is fixed to the holder base 110 is disposed further to the inside in the radial direction of the holder base 110, than the upper side portion which holds the rotor 2. An inclined portion is provided in the knitting element 1 between the upper side portion which holds the rotor 2 and the lower side portion which is fixed to the holder base 110. In this way, since a composition is adopted in which the knitting element 1 comprises an inclined section and the lower side portion is disposed to the inside of the upper side portion in the radial direction of the holder base 110, then it is possible to ensure space for arranging the drive gear wheel 82 on the outside of the holder base 110, and the circular knitting machine 110 can be made compact in size. More specifically, it is possible to restrict the external protrusion of elements.

(Knitting Machine Control Apparatus)

Figure 34:
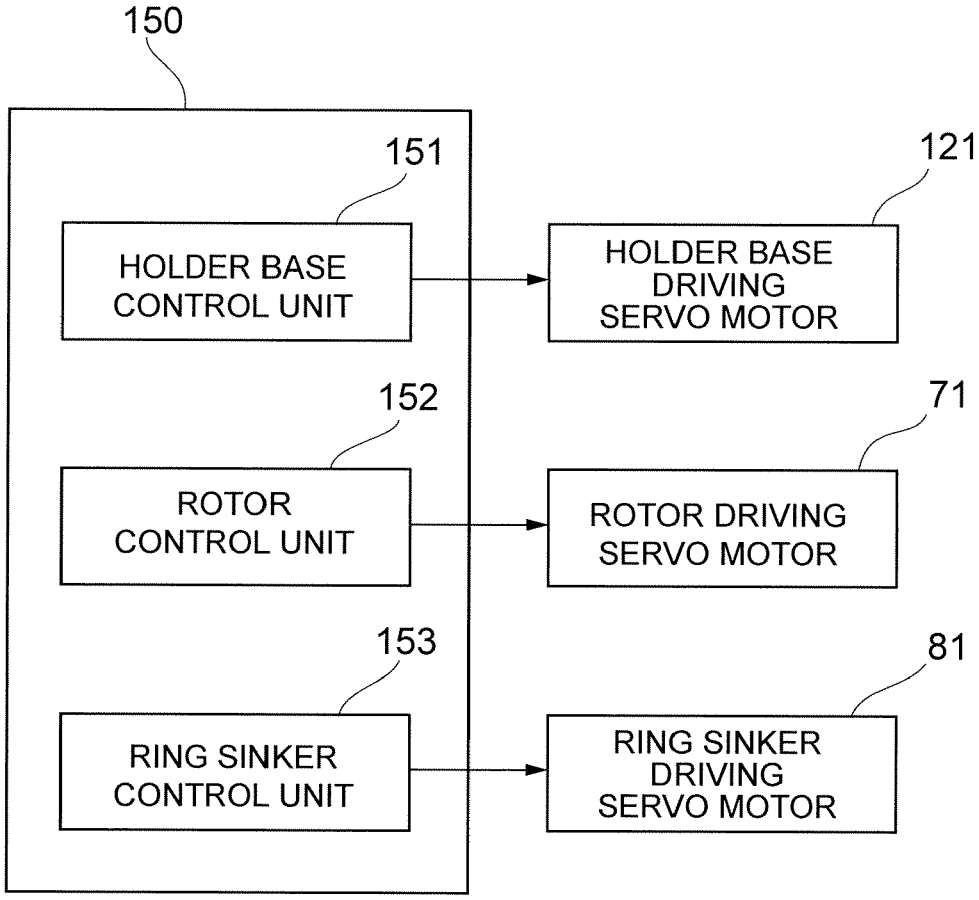
FIG. 34 is a block diagram showing a knitting machine control apparatus.

Next, a knitting machine control apparatus relating to an embodiment will be described. FIG. 34 is a block diagram showing a knitting machine control apparatus. The knitting machine control apparatus 150 shown in FIG. 34 is constituted by a CPU which performs calculation processing, a ROM and a RAM which form a storage unit, an input signal circuit, an output signal circuit, a power supply circuit, and the like. In the knitting machine control apparatus 150, a holder base control unit 151, a rotor control unit 152 and a ring sinker control unit 153 are created by executing a program stored in the storage unit.

The holder base control unit 151 (holding platform control means) controls the angle of rotation of the holder base 110 by controlling the holder base driving servo motor 121 (holding platform rotation drive means). The holder base control unit 151 controls the rotational position of the holder base 110 by controlling the holder base driving servo motor 121.

The rotor control unit 152 (rotor control means) controls the angle of rotation of the rotor 2 by controlling the rotor driving servo motor 71 (rotor rotation drive means). The rotor control unit 152 controls the rotational position of the rotor 2 by controlling the rotor driving servo motor 71.

The ring sinker control unit 153 (rotary sinker control means) controls the angle of rotation of the ring sinker 4 by controlling the ring sinker driving servo motor 81 (rotary sinker rotation drive means). The ring sinker control unit 153 controls the rotational position of the ring sinker 4 by controlling the ring sinker driving servo motor 81.

Desirably, the knitting machine control apparatus 150 moves the rotor 2 through an amount corresponding to a second angle of rotation after the holder base 110 has moved by an amount corresponding to a first angle of rotation, and the ring sinker control unit 153 moves the ring sinker 4 by an amount corresponding to a third angle of rotation after the rotor 2 has moved by an amount corresponding to a second angle of rotation.

Figure 35:
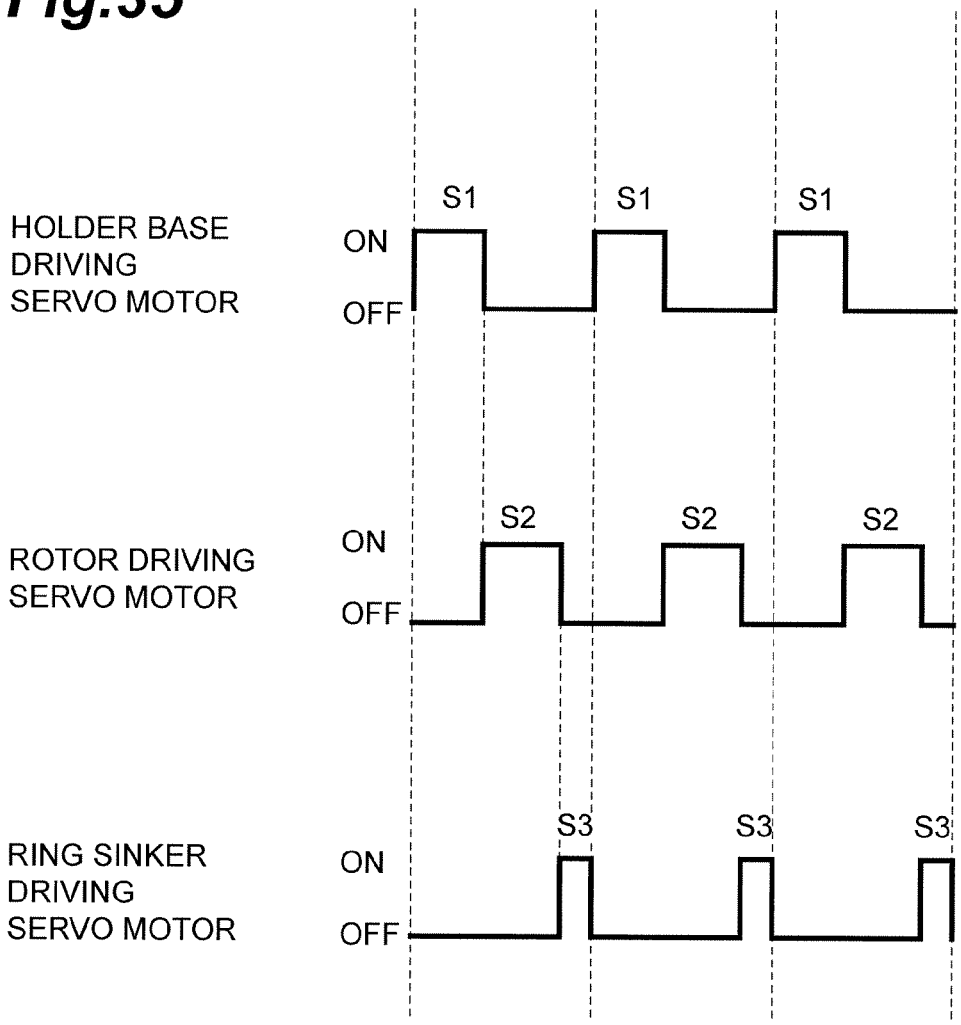
FIG. 35 is a time chart showing the operational timing of the rotational control of the holder base, the rotor and the ring sinker.

FIG. 35 is a time chart showing the operational timing of the rotational control of the holder base, the rotor and the ring sinker. FIG. 35 shows the operation start timing and the operation times of the respective servo motors. In the present embodiment, a case is described in which the number of knitting elements 1 installed on the holder base 110 is 40, the number of rotary sinkers 3 installed on the holder base 110 is 40, the number of rotary teeth 21 on the rotor 2 is 8, and the number of sinker teeth 41 on the ring sinker 4 is 12.

Firstly, the holder base control unit 151 sends a command signal and causes the holder base drive servo motor 121 to operate (step S1). By this means, the holder base driving servo motor 121 causes the holder base 110 to rotate through 9 degrees in the direction of arrow R. In this case, the knitting elements 1 installed on the holder base 110 move in the direction of arrow R and move to a rotational position where a rotor 2 and the drive gear wheel 72 mesh with each other. Similarly, the rotary sinkers 3 installed on the holder base 110 move in the direction of arrow R and move to a rotational position where a ring sinker 4 and the drive gear wheel 82 mesh with each other.

Thereupon, after the rotational movement of the holder base 110 (S1), the rotor control unit 152 transmits a command signal and causes the rotor driving servo motor 71 to operate (step S2). Accordingly, the rotor driving servo motor 71 causes the rotor 2 to rotate through 180 degrees in the direction of arrow a. In this case, a stitch is formed by the hook 22 of the rotor 2 capturing a knitting yarn and rotating in the direction of arrow a.

Thereupon, after the rotational movement of the rotor 2 (S2), the ring sinker control unit 153 transmits a command signal and causes the ring sinker driving servo motor 81 to operate (step S3). Accordingly, the ring sinker driving servo motor 81 causes the ring sinker 4 to rotate through 30 degrees in the direction of arrow c. In this case, the ring sinker 4 is conveyed by an amount corresponding to one tooth, and the old loop captured by the rotor 2 is released from the hook 22.

One course of stitches is formed by repeating the operation in these steps S1 to S3 forty times. By controlling the operation of the circular knitting machine 100 using the knitting machine control apparatus 150 relating to the present embodiment, it is possible to achieve simultaneous control in such a manner that the rotational timings and rotational angles of the servo motors 71, 81, 121 do not interfere with each other. It is also possible to control the rotation of the rotors 2, the ring sinkers 4 and the holder base 110 at other timings. For example, it is also possible to operate the rotation of the ring sinker 4 during rotational movement (S2) of the rotor 2.

(Modification Example of Knitting Element)

Figure 31:
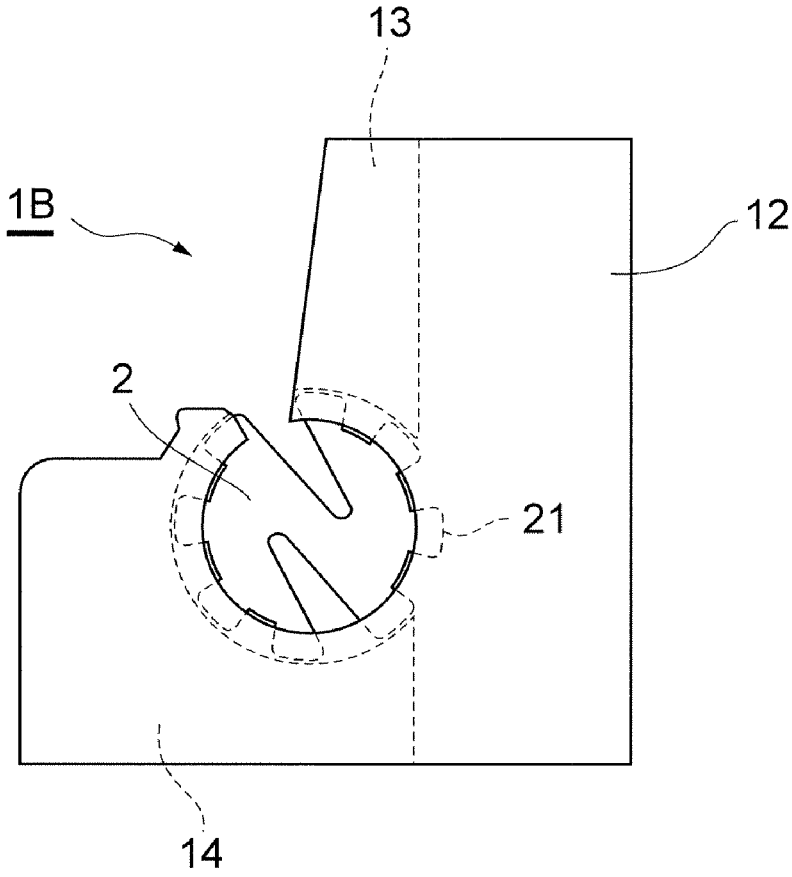
FIG. 31 is a side view diagram showing a modification example of a knitting element relating to an embodiment of the present invention.

FIG. 31 is a side view showing a modification example of a knitting element relating to an embodiment of the present invention. The knitting element 1B shown in FIG. 31 comprises a rotor 2, inner plates 13, 14 and outer plates 12. The outer plates 12 of the knitting element 1B are formed so as to project to the front side beyond the inner plates 13, 14. In side view, the rotor teeth 21 of the rotor 2 protrude to the front side beyond the inner plates 13, 14, but do not protrude to the front side beyond the outer plates 12.

Figure 32:
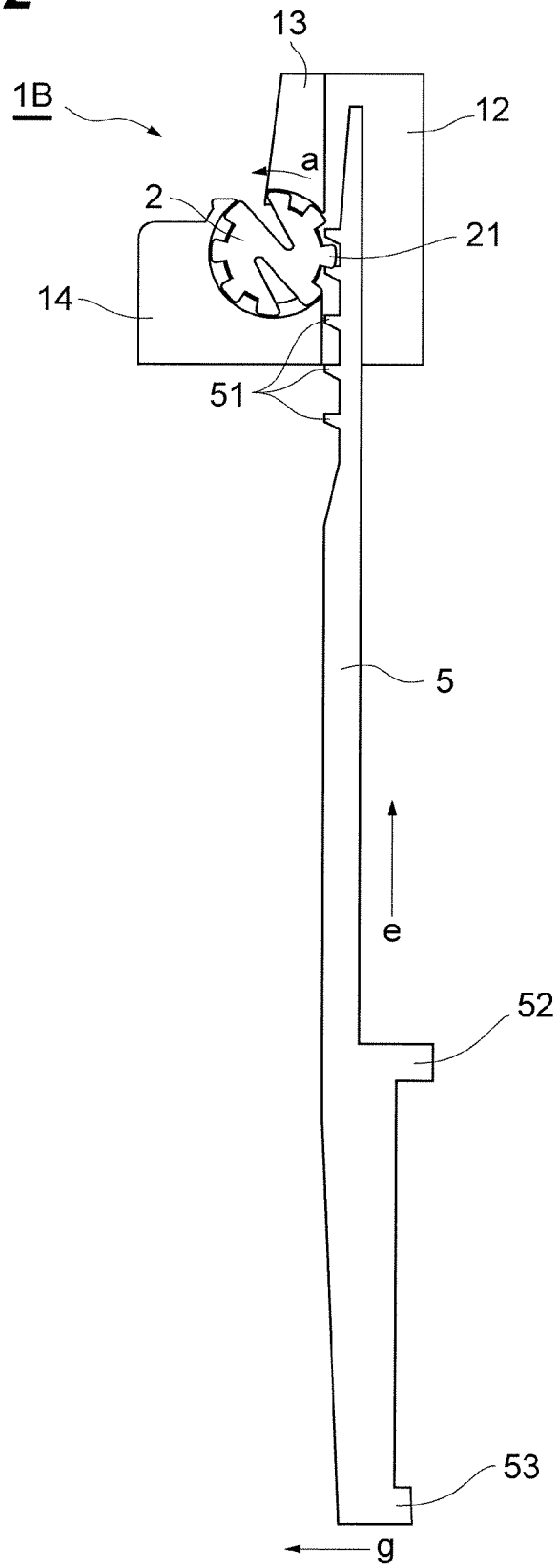
FIG. 32 is a diagram showing a knitting element and a drive jack which meshes with the rotor of the knitting element.

FIG. 32 is a diagram showing a knitting element and a drive jack which meshes with the rotor of the knitting element. The rotor 2 of the knitting element 1B according to the modification example is driven to rotate by a drive jack 5 which moves reciprocally. The drive jack 5 has a prescribed length and a plurality of saw-shaped jack teeth 51 which engage with the rotor teeth 21 are provided in one end portion of the drive jack 5 in the lengthwise direction. In the drive jack 5 according to the present embodiment, five projecting sections, for example, are provided.

The drive jack 5 is inserted in between the pair of outer plates 12, in the thickness direction of the knitting element 1. In the state shown in FIG. 32, when the drive jack 5 is raised in the direction of arrow e, the rotor 2 is driven by the jack teeth 51 and caused to rotate in the direction of arrow a.

The drive jack 5 is inserted into a groove formed in the holder base 110 of the circular knitting machine 100 and rotates in a circumferential direction together with the holder base 110. The drive jack 5 is disposed at the same position as the knitting element 1B, in the circumferential direction of the holder base 110.

A butt 52 which projects to the opposite side from the jack teeth 51 is provided on the lower side of the drive jack 5. A cam (not illustrated) is provided on the holder base 110. When the holder base 110 is driven to rotate, the butt 52 is guided by the cam and the drive jack 5 rises and descends. Accordingly, the jack teeth 51 of the drive jack 5 cause the rotor 2 to rotate.

Figure 33:
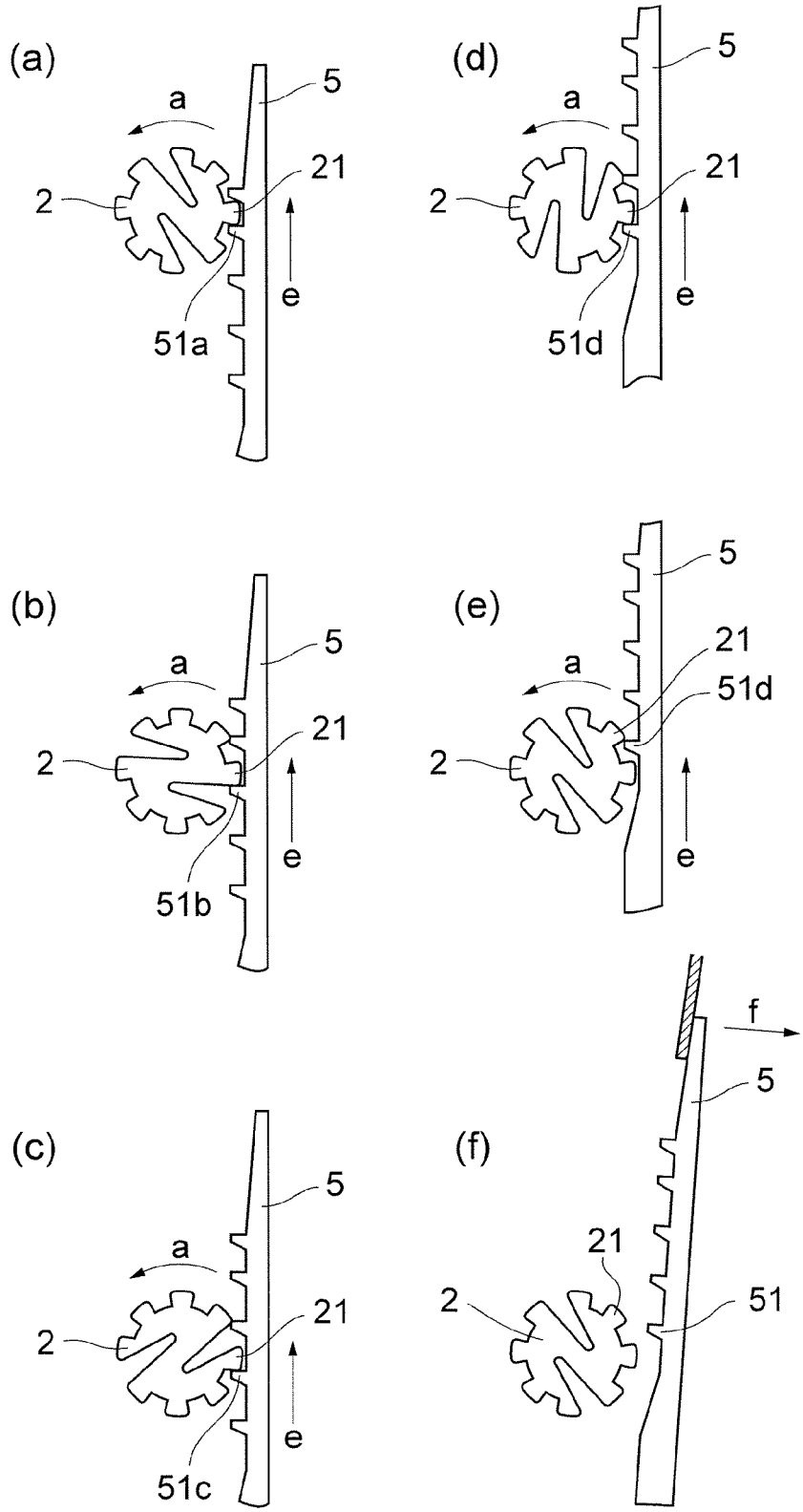
FIG. 33 is a diagram showing a drive cycle of a rotor by the drive jack.

FIG. 33 is a diagram showing a drive cycle of a rotor by the drive jack. With the jack teeth 51*a* meshed with the rotor teeth 21, the drive jack 5 rises in the direction of arrow e, and the rotor 2 rotates in the direction of arrow a (see (a) of FIG. 33).

Moreover, when the drive jack 5 is raised in the direction of arrow e, the rotor 2 is driven to rotate by the jack teeth 51*b* to 51*e* (see (b) to (e) of FIG. 33). The rotor 2 is rotated through 180 degrees due to being conveyed by an amount corresponding to four rotor teeth 21, by the jack teeth 51*a* to 51*d*.

In the state shown in (e) of FIG. 33, the raising of the drive jack 5 is halted, and as shown in (f) of FIG. 33, the front end portion of the drive jack 5 is moved in a direction away from the rotor 2 and the meshing between the rotor teeth 21 and the jack teeth 51 is released. For example, due to the butt 53 provided on the lower end of the drive jack 5 being pressed in the direction of arrow g, as shown in FIG. 32, the front end portion of the drive jack 5 is detached in the direction of arrow f. In this state, the drive jack 5 is lowered in the opposite direction to the direction of arrow e, and returns to the state shown in (a) of FIG. 33. In this case, the rotation of the rotor 2 is halted. In this way, by repeating the states shown in (a) to (f) of FIG. 33, the rotor 2 is driven to rotate using the drive jack 5 and knitting can be carried out.

The present invention was described in concrete terms above on the basis of embodiments thereof, but the present invention is not limited to the embodiments described above. In the embodiment given above, the application of a knitting element to a circular knitting machine is described, but the knitting element according to the present invention may also be applied to other knitting machines, such as a flat knitting machine, or a warp knitting machine, or the like.

The rotor 2 held by the knitting element 1B may be a rotor 2B, 2C of another shape, or a rotor of yet a different shape. Furthermore, it is also possible to apply a rotary sinker to a conventional knitting element which does not comprise a rotor.

The knitting element 1 may be applied to another knitting machine, other than a circular knitting machine. Furthermore, it is also possible to apply the knitting element 1 to a knitting machine comprising a conventional reciprocating sinker, instead of a rotary sinker 3. Moreover, the knitting machine may be composed without including a sinker.

Furthermore, desirably, a step difference is provided in the fixing section of the knitting element 1 and the fixing section of the rotary sinker 3. In this way, by providing a step difference in the fixing section and providing a step difference also in a corresponding groove of the holder base 110, it is possible to register the knitting element 1 and the rotary sinker 3 in position and to restrict movement in the radial direction. By this means, the movement of the knitting element 1 and the rotary sinker 3 is restricted, even if the holder base 110 rotates, and therefore it is possible to achieve a stable action.

According to the knitting element, the knitting machine and the rotors according to the embodiment of the present invention described above, it is possible to control the rotation of the rotors independently, and a practicable knitting machine can be achieved.

What is claimed is:

1. A knitting element, which has a rotor capable of rotating about an axis and carries out knitting using a rotational movement of the rotor, the knitting element comprising:

the rotor, which is formed in a circular disk shape, and the circumferential surface of which forms a sliding surface;

a pair of bearing plates which are separated from each other in a radial direction of the rotor and slidably support the circumferential surface of the rotor; and a pair of supporting plates which are disposed on either side of the rotor in a thickness direction so as to sandwich the rotor and the pair of bearing plates, and which support the rotor and the pair of bearing plates, wherein the bearing plates and the supporting plates are integrated to constitute a thin plate shape, the rotor is provided with an engaging recess section which passes through the rotor in the thickness direction and is opened from the circumferential surface side toward the inside of the rotor, a plurality of teeth to which rotational drive force is transmitted are formed in a circumference edge portion of the rotor, and a knitting yarn introduction opening through which a knitting yarn enters and exits from the engaging recess section is formed in each of the pair of supporting plates.

2. A rotor of a knitting element which carries out knitting using a rotational movement; comprising:

a rotor main body, which is formed in a circular disk shape, and the circumferential surface of which forms a sliding surface, wherein the rotor main body is provided with an engaging recess section which passes through the rotor main body in a thickness direction and is opened from the circumferential surface side toward the inside of the rotor main body, and a plurality of teeth to which rotational drive force is transmitted are formed in a circumference edge portion of the rotor.

3. The rotor of a knitting element according to claim 2, wherein the engaging recess section is formed more deeply in a radial direction of the rotor main body than a recess section formed between the plurality of teeth.

4. The rotor of a knitting element according to claim 2, wherein the engaging recess section is formed deeply beyond the center of the rotor main body to the opposite side, in side view.

5. The rotor of a knitting element according to claims 2, wherein a step difference is formed in the engaging recess section so as to enable a plurality of knitting yarns to be engaged at different positions.

6. A knitting machine comprising:

a knitting element which has a rotor capable of rotating about an axis extending in a first direction and carries out knitting by using a rotational movement of the rotor; and a holding platform which holds the knitting element and causes the knitting element to rotate about a second axis extending in a second direction perpendicular to the first direction, wherein the knitting element includes:

the rotor, which is formed in a circular disk shape, and the circumferential surface of which forms a sliding surface;

a pair of bearing plates which are separated from each other in a radial direction of the rotor and slidably support the circumferential surface of the rotor; and a pair of supporting plates which are disposed on either side of the rotor in a thickness direction so as to sandwich the rotor and the pair of bearing plates, and which support the rotor and the pair of bearing plates, and wherein the bearing plates and the supporting plates are integrated to constitute a thin plate shape, the rotor is provided with an engaging recess section which passes through the rotor in the thickness direction and is opened from the circumferential surface side toward the inside of the rotor, a plurality of teeth to which drive force is transmitted are formed in a circumference edge portion of the rotor, and a knitting yarn introduction opening through which a knitting yarn enters and exits from the engaging recess section is formed in each of the pair of supporting plates.

7. The knitting machine according to claim 6, further comprising:

a rotor drive gear wheel which meshes with a plurality of teeth provided on the circumference edge portion of the rotor; and a rotor servo motor which applies rotational drive force to the rotor drive gear wheel.

* * * * *